US006408157B1

(12) United States Patent
Tanaka et al.

(10) Patent No.: US 6,408,157 B1
(45) Date of Patent: Jun. 18, 2002

(54) IMAGE FORMING APPARATUS

(75) Inventors: Toshiaki Tanaka, Fukaya; Kazuo Matsumoto, Tokyo, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/784,194

(22) Filed: Feb. 16, 2001

(51) Int. Cl.[7] ..... G03G 15/01; G03G 15/00

(52) U.S. Cl. ..... 399/301; 347/116; 399/49; 399/167

(58) Field of Search ..... 399/299, 301, 399/167, 46, 49; 347/115, 116

(56) References Cited

U.S. PATENT DOCUMENTS

| | | | | |
|---|---|---|---|---|
| 5,515,154 A | * | 5/1996 | Hasegawa et al. | 399/167 |
| 5,881,346 A | | 3/1999 | Mori et al. | 399/301 |
| 5,995,717 A | | 11/1999 | Tanaka | 395/109 |
| 5,995,802 A | | 11/1999 | Mori et al. | 399/394 |
| 6,049,690 A | | 4/2000 | Nakayasu et al. | 399/301 |
| 6,070,041 A | | 5/2000 | Nakayasu et al. | 399/301 |
| 6,198,490 B1 | * | 3/2001 | Eom et al. | 347/116 |
| 6,198,495 B1 | * | 3/2001 | Sawada | 347/116 |
| 6,212,345 B1 | * | 4/2001 | Harada et al. | 399/167 |
| 6,278,857 B1 | * | 8/2001 | Monji et al. | 347/116 |

FOREIGN PATENT DOCUMENTS

| | | |
|---|---|---|
| JP | 9-146329 | 6/1997 |
| JP | 10-78734 | 3/1998 |
| JP | 10-333398 | 12/1998 |

* cited by examiner

*Primary Examiner*—Susan S. Y. Lee
(74) *Attorney, Agent, or Firm*—Foley & Lardner

(57) ABSTRACT

According to this invention, correction values based on the phase differences of speed changes in one rotation of the photosensitive drums that are determined based on uniform-density halftone bands for respective colors recorded on a recording medium are set in a 4-drum tandem type full-color copying machine. The rotational speeds of the photosensitive drums are increased or decreased on the basis of the correction values, thereby locking the phases of speed changes in one rotation of the photosensitive drums. This can solve a problem that the periods of rotational variations of the photosensitive drums differ from each other to generate large image misalignment in the 4-drum tandem type full-color copying machine. By locking the phases of the periods of rotational variations of the photosensitive drums, image misalignment can be minimized and reduced.

26 Claims, 21 Drawing Sheets

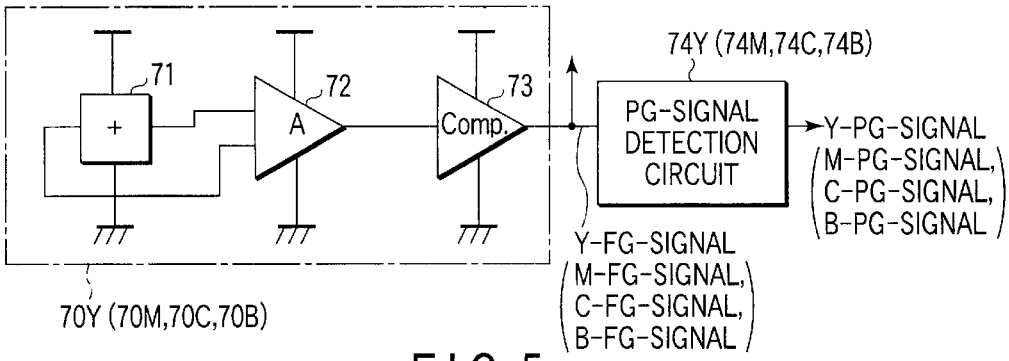
FIG. 5
FIG. 6
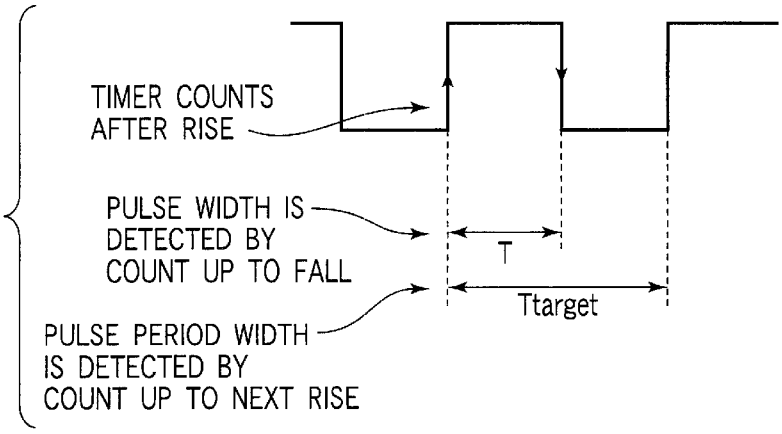
FIG. 7A
FIG. 7B
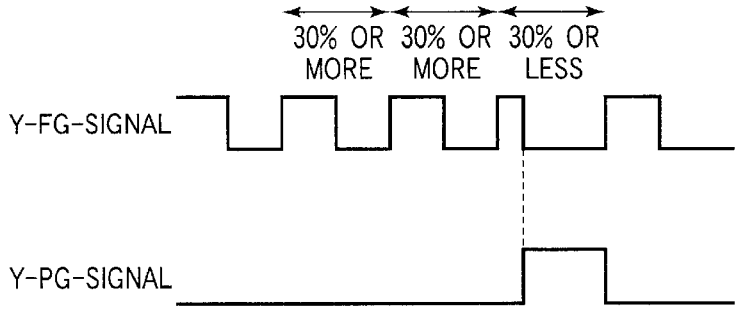

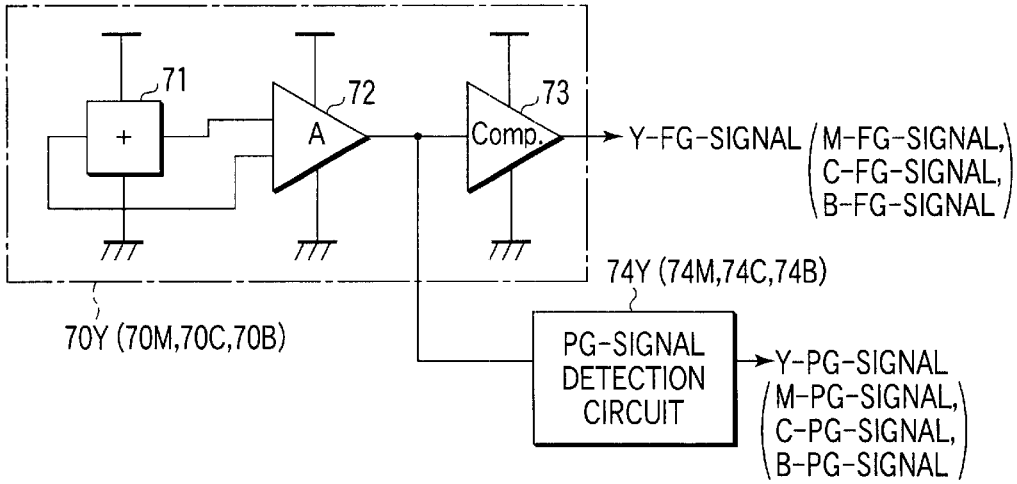
FIG. 8
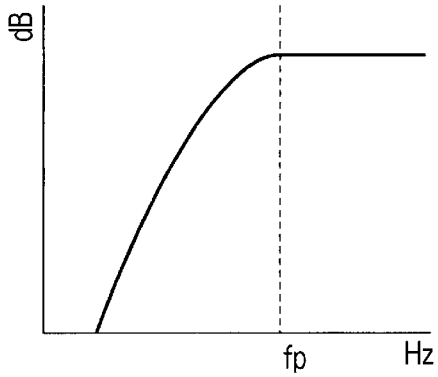
FIG. 9
FIG. 10A Y-FG-SIGNAL
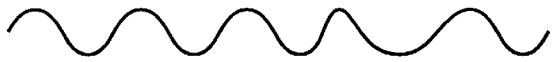
FIG. 10B Y-PG-SIGNAL
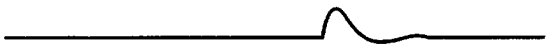

FIG. 20A Y-PG-SIGNAL
FIG. 20B Y-FG-SIGNAL
FIG. 20C M-PG-SIGNAL
FIG. 20D M-FG-SIGNAL
FIG. 20E C-PG-SIGNAL
FIG. 20F C-FG-SIGNAL
FIG. 20G B-PG-SIGNAL
FIG. 20H B-FG-SIGNAL

IMAGE FORMING APPARATUS

BACKGROUND OF THE INVENTION

The present invention relates to an image forming apparatus such as a full-color copying machine or color printer.

A known example of a conventional image forming apparatus for outputting a color image is a so-called 4-drum tandem type full-color copying machine constituted by parallel-arranging, along a convey belt, four image forming units for forming toner images of yellow (Y), magenta (M), cyan (C), and black (B) on the basis of color-separated image signals.

The image forming unit of each color has a photosensitive drum in rolling contact with the convey belt, a charging device for charging the drum surface to a predetermined potential, an exposure device for exposing the drum surface to form an electrostatic latent image, a developing device for supplying toner to develop the electrostatic latent image on the drum surface, and a transfer device for transferring the developed toner image to a recording sheet which is attracted and conveyed by the convey belt. The recording sheet attracted by the convey belt is conveyed through the four image forming units, and toner images of the respective colors are transferred over each other on the recording sheet. Then, the recording sheet is fed to a fixing device where the toner images of the respective colors are fixed to the recording sheet to form a color image.

In the 4-drum tandem type full-color copying machine using a DC motor for driving the photosensitive drums, the four photosensitive drums have the same diameter, a multi-pulse encoder is used to increase the rotational precision, and constant angular speed control using the pulse signal is employed.

The photosensitive drum is shorter in service life than the whole apparatus, and must be exchanged every several ten thousand prints. For this purpose, the photosensitive drum has an arrangement (mechanism) detachable via a coupling connected to a DC motor serving as a driver for the photosensitive drum. Although the axial shift of this mechanism must be minimum, the number of separation components increases because of the detachable arrangement, and the axial shift greatly increases owing to the size difference or play between components. The axial shift causes variations in rotational angle (peripheral speed) of the periodicity (appearing as a sine wave) in one rotation of the photosensitive drum.

In the 4-drum tandem type full-color copying machine, therefore, the periods of rotational variations of the respective photosensitive drums differ from each other, and large image misalignment (density difference or rainbow noise) occurs.

When DC motors are used as drivers for the respective photosensitive drums, the photosensitive drums are not controlled in activation or stop. Even if the periods of rotational variations of the photosensitive drums are temporarily adjusted, peripheral speed variations of the photosensitive drums are out of phase.

BRIEF SUMMARY OF THE INVENTION

It is an object of the present invention to solve a problem that the periods of rotational variations of respective photosensitive drums differ from each other to generate large image misalignment in a 4-drum tandem type full-color copying machine, and lock the phases of the periods of rotational variations of the photosensitive drums, thereby minimizing and reducing image misalignment.

To achieve the above object, the present invention provides an image forming apparatus characterized by comprising a convey portion for conveying a recording medium, a plurality of image forming units which are aligned on the convey portion, have rotational photosensitive drums, and transfer images of different colors to the recording medium conveyed by the convey portion, output means for outputting a pattern representing speed changes in one rotation of the photosensitive drums of the respective image forming units, setting means for setting correction values based on phase differences of the speed changes in one rotation of the photosensitive drums that are determined from an output from the output means, and correction means for locking phases of the speed changes in one rotation of the photosensitive drums by increasing or decreasing rotational speeds of the photosensitive drums on the basis of the correction values set by the setting means.

The present invention provides an image forming apparatus comprising a convey portion for conveying a recording medium a plurality of image forming units which are aligned on the convey portion, have rotational photosensitive drums, and transfer images of different colors to the recording medium conveyed by the convey portion output means for outputting a pattern representing speed changes in one rotation of the photosensitive drums of the respective image forming units detecting means for detecting phase differences of the speed changes in one rotation of the photosensitive drums, outputted from the plurality of image forming units setting means for setting correction values based on results detected by the detecting means and correction means for locking phases of the speed changes in one rotation of the photosensitive drums by increasing or decreasing rotational speeds of the photosensitive drums on the basis of the correction values set by the setting means.

The present invention provides an image forming apparatus comprising a convey portion for conveying a recording medium a plurality of image forming units which are aligned on the convey portion, have rotational photosensitive drums, and transfer images of different colors to the recording medium conveyed by the convey portion creating means for creating a pattern of a registration mark for each of the different colors generating means for generating a toner image of the pattern of the registration mark for each of the different colors, created by the creating means, to the convey portion by the respective image forming units;

a detector, provided along the convey portion on a downstream of the image forming unit, for detecting the toner image of the pattern of the registration mark for the respective colors generated onto the convey portion measurement means for measuring speed changes in one rotation of the respective photosensitive drums, based on the pattern of the registration mark for the respective colors, detected by the detector setting means for setting correction values based on results detected by the detecting means and correction means for locking phases of the speed changes in one rotation of the photosensitive drums by increasing or decreasing rotational speeds of the photosensitive drums on the basis of the correction values set by the setting means.

BRIEF DESCRIPTION OF SEVERAL VIEWS OF THE DRAWING

FIG. 5 is a circuit diagram showing the schematic arrangement of a PG-signal detector;

FIG. 6 is a chart for explaining the detection method of a PG-signal detection circuit;

FIG. 7 is a chart showing an FG-signal;

FIG. 7B is a chart showing a PG-signal;

FIG. 8 is a circuit diagram showing the schematic arrangement of the PG-signal detector;

FIG. 9 is a graph for explaining the detection method o the PG-signal detection circuit;

FIG. 10A is a chart showing the FG-signal;

FIG. 10B is a chart showing the PG-signal;

DETAILED DESCRIPTION OF THE INVENTION

Image forming apparatuses according to embodiments of the present invention will be described below with reference to the several views of the accompanying drawing.

First Embodiment

Figure 1:
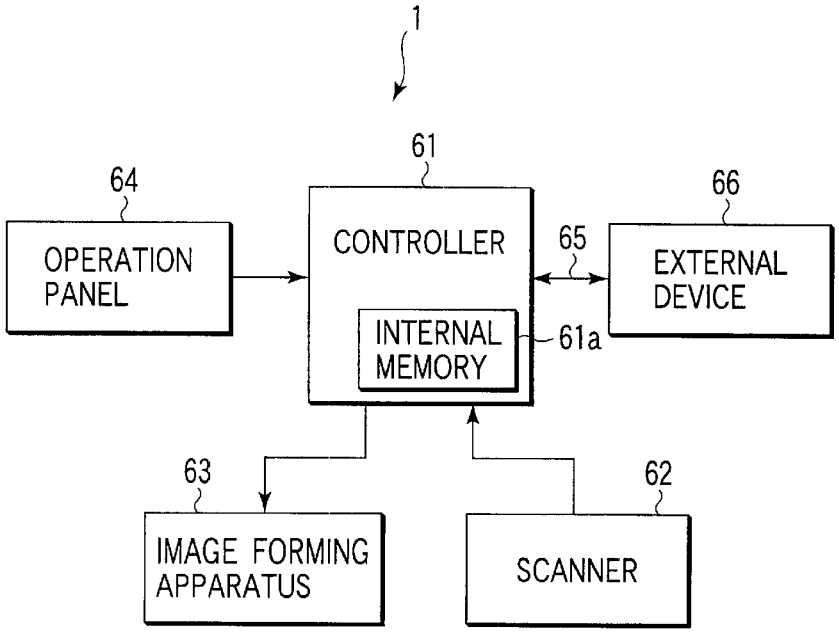
FIG. 1 is a block diagram showing the schematic arrangement of a color image forming apparatus.

FIG. 1 is a block diagram showing a color digital copying apparatus 1 as an example of a color image forming apparatus of the present invention.

As shown in FIG. 1, the color digital copying apparatus 1 is constituted by a controller (CPU) 61, scanner 62, image forming apparatus 63, and operation panel 64. The color digital copying apparatus 1 is connected to an external device 66 such as a personal computer via a line 65 such as a LAN.

The controller (CPU) 61 controls the whole color digital copying apparatus 1.

The scanner 62 reads image information of an object to be copied (not shown) as density, and generates an image signal.

The image forming apparatus 63 forms an image corresponding to an image signal supplied from the scanner 62 or external device 66.

The operation panel 64 performs various settings.

The controller 61 has an internal memory 61*a*. The internal memory 61*a* registers a self-printing image pattern for recognizing the phase of a rotational angle variation.

Figure 2:
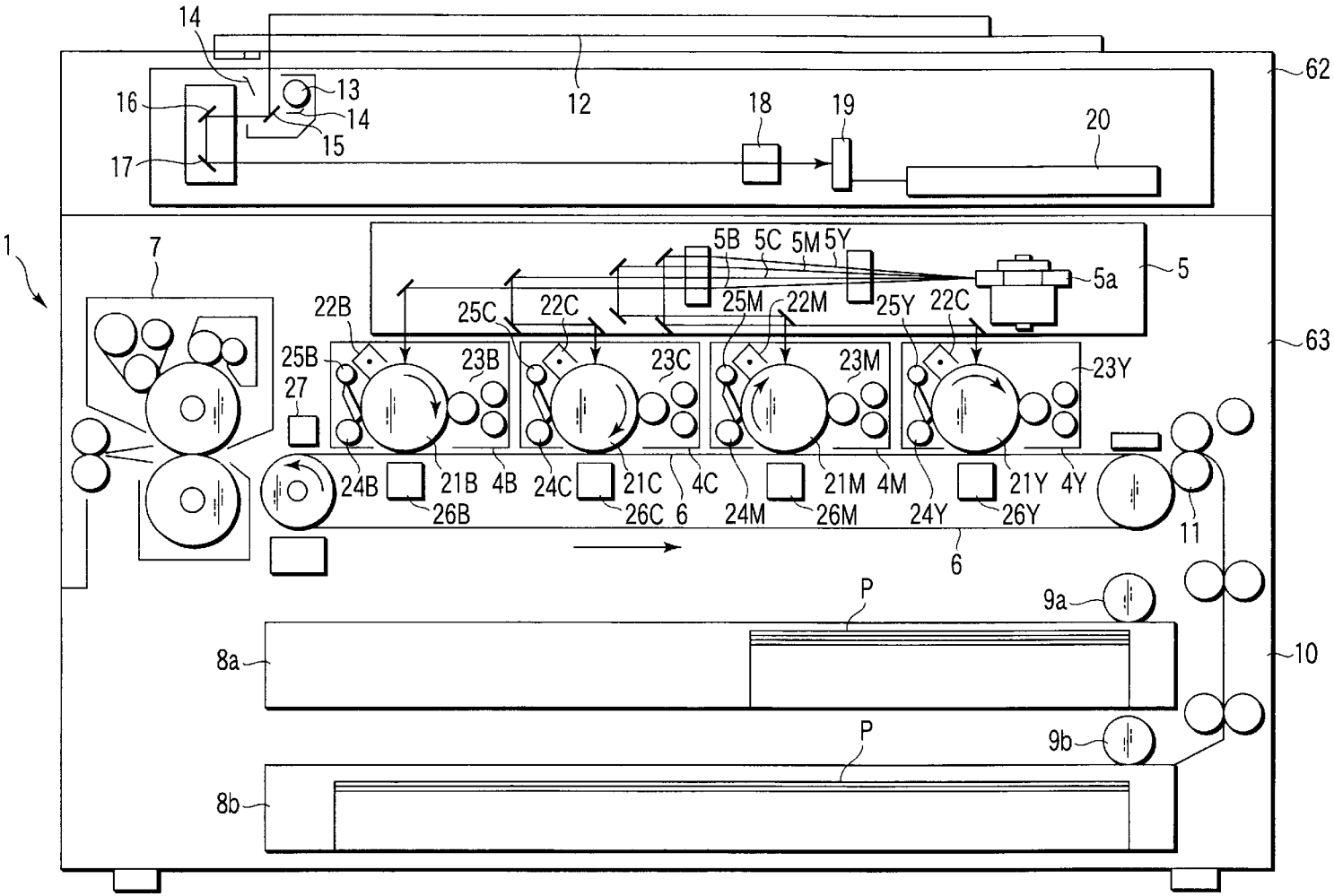
FIG. 2 is a sectional view showing the schematic arrangement of the color image forming apparatus.

FIG. 2 is a sectional view of an internal arrangement for explaining the color digital copying apparatus 1.

As shown in FIG. 2, the scanner 62 comprises an illumination lamp 13 for illuminating an original (not shown) placed on an original table 12, a reflector 14 for converging light from the illumination lamp 13 to the original, an optical system 20 for guiding light reflected by the original to a light-receiving element 19 using reflecting mirrors 15, 16, and 17, an imaging lens 18, and the like, the light-receiving element 19 such as a CCD for converting light from the original into an electrical signal, and an image processing device 20 for separating the photoelectrically converted electrical signals into respective colors, and generating image signals of yellow (Y), magenta (M), cyan (C), and black (B)

As shown in FIG. 2, the image forming apparatus 63 comprises four image forming sections 4Y, 4M, 4C, and 4B for forming images of four colors, i.e., three, Y (Yellow), M (Magenta), and C (Cyan) colors serving as color components in subtractive primaries, and B (Black) color for reinforcing the contrast, an exposure device 5 for irradiating photosensitive drums 21Y, 21M, 21C, and 21B respectively arranged in the image forming sections 4Y, 4M, 4C, and 4B with exposure light, e.g., a laser beam whose light intensity is intermittently changed in correspondence with image signals supplied from the scanner 62 or externally, a transfer belt 6 for sequentially overlapping images formed in the image forming sections 4Y, 4M, 4C, and 4B on a sheet P while conveying the sheet P as a member to be transferred (target image formation medium), and a fixing device 7 for fixing developer images to the sheet P by applying a pressure while heating the sheet P and the images (developer images) on the sheet P that are conveyed by the transfer belt 6.

The image forming sections 4Y, 4M, 4C, and 4B have almost the same arrangement, and form images corresponding to the respective colors by a known electrophotographic process. Note that the photosensitive drums 21Y, 21M, 21C, and 21B have the same diameter.

The photosensitive drums 21Y, 21M, 21C, and 21B are surrounded along the rotational direction by charging devices 22Y, 22M, 22C, and 22B, developing devices 23Y, 23M, 23C, and 23B which store developers (toners) of corresponding colors, transfer devices 26Y, 26M, 26C, and 26B, cleaning devices 24Y, 24M, 24C, and 24B, and charge removing devices 25Y, 25M, 25C, and 25B. Color images corresponding to laser beams 5Y, 5M, 5C, and 5B which are emitted by the exposure device 5 and scanned by a polygon mirror 5*a* in accordance with color-separated image signals are formed.

The transfer devices 26Y, 26M, 26C, and 26B are arranged at opposite positions below the corresponding photosensitive drums 21Y, 21M, 21C, and 21B via the transfer belt 6.

Sheet cassettes 8*a* and 8*b* which hold sheets P to which toner images formed by the image forming sections 4Y, 4M, 4C, and 4B are transferred are set at predetermined positions below the transfer belt 6. The sheet cassettes 8*a* and 8*b* respectively have pickup rollers 9*a* and 9*b* for picking up sheets P stored in the cassettes one by one. A sheet convey portion 10 made up of a guide and rollers for feeding sheets P picked up by the pickup rollers 9*a* and 9*b* to the transfer belt 6 is formed between the sheet cassettes 8*a* and 8*b* and the transfer belt 6. Aligning rollers 11 for setting a timing at which a sheet P is fed to the transfer belt 6 are arranged at a predetermined position of the sheet convey portion 10 on the transfer belt 6 side in order to match the position of the sheet P which is picked up from either cassette and conveyed by the sheet convey portion 10, with the positions of images formed in the image forming sections 4Y, 4M, 4C, and 4B.

In the color image forming apparatus 1 shown in FIG. 2, when an image signal is supplied from the scanner 62 or external device 66, the photosensitive drums 21Y, 21M, 21C, and 21B of the image forming sections 4Y, 4M, 4C, and 4B are charged to predetermined potentials by a charging power supply (not shown) in time-series. The exposure device 5 irradiates the respective photosensitive drums 21Y, 21M, 21C, and 21B with a laser beam whose light intensity is intermittently changed on the basis of the image signal.

Then, electrostatic latent images corresponding to a color image to be output are formed on the photosensitive drums 21Y, 21M, 21C, and 21B of the four image forming sections 4Y, 4M, 4C, and 4B. Timings at which images are exposed on the photosensitive drums 21Y, 21M, 21C, and 21B of the image forming sections 4Y, 4M, 4C, and 4B are defined in a predetermined order in accordance with movement of a sheet P conveyed on the transfer belt 6.

The electrostatic latent images formed on the photosensitive drums 21Y, 21M, 21C, and 21B of the image forming sections 4Y, 4M, 4C, and 4B are developed by selectively providing toners from the developing devices 23Y, 23M, 23C, and 23B which are arranged in the corresponding image forming sections 4Y, 4M, 4C, and 4B and store toners (developers) of the predetermined colors. The toner images are sequentially transferred to the sheet P on the transfer belt 6 by the transfer devices facing the photosensitive drums 21Y, 21M, 21C, and 21B via the transfer belt 6.

Note that the sheet P is picked up from a cassette which stores sheets P of a pre-selected size or a size corresponding to the size of an image to be exposed by the exposure device 5. The sheet P is conveyed up to the aligning rollers 11 of the sheet convey portion 10, and temporarily stopped at the aligning rollers 11.

The sheet P is fed from the aligning rollers 11 to the transfer belt 6 in synchronism with exposure of an image of the first color by the exposure device 5 or at a predetermined timing. At this time, the sheet P is charged by a charging device (for the sheet P) arranged near a roller on the sheet feed portion side that supports the transfer belt 6, and tightly contacts the transfer belt 6.

The sheet P bearing the toners, i.e., toner images formed by the image forming sections 4Y, 4M, 4C, and 4B is conveyed to the fixing device 7, and the toners fused by the fixing device 7 are fixed.

A motor controller 30 for controlling rotation of the photosensitive drums 21Y, 21M, 21C, and 21B will be explained with reference to FIG. 3.

The motor controller 30 is constituted by motor drivers 32Y, 32M, 32C, and 32B for driving DC motors 31Y, 31M, 31C, and 31B for respectively rotating the photosensitive drums 21Y, 21M, 21C, and 21B, and a control circuit 33.

The control circuit 33 is formed from a control ASIC including an APC ON circuit 34, motor control circuits 35Y, 35M, 35C, and 35B, PG-signal detection circuits 70Y, 70M, 70C, and 70B, and phase adjustment circuits 74Y, 74M, 74C, and 74B.

A coupling transmission section or the like (not shown) couples the photosensitive drums 21Y, 21M, 21C, and 21B to the rotation driving DC motors 31Y, 31M, 31C, and 31B. The DC motors 31Y, 31M, 31C, and 31B are driven by the separate motor control circuits 35Y, 35M, 35C, and 35B, respectively.

Figure 4:
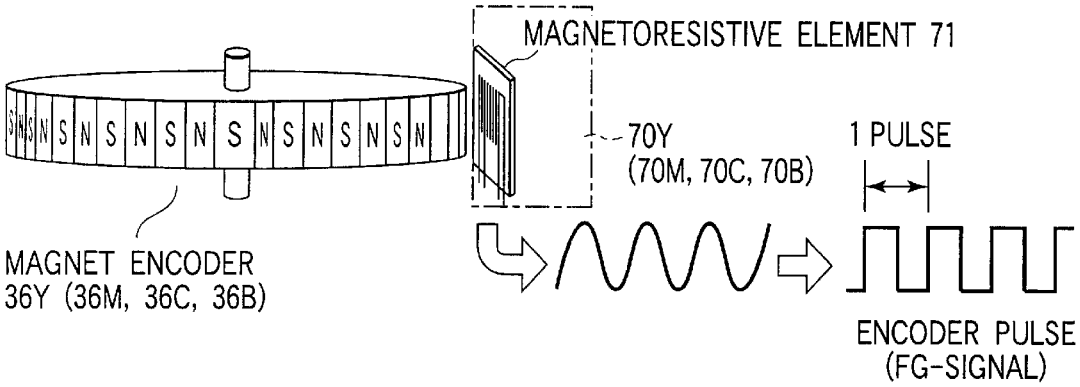
FIG. 4 is a view showing a magnet encoder attached to a DC motor and a magnetoresistive element for outputting an FG-signal on the basis of the magnet encoder.

A magnet encoder 36Y as shown in FIG. 4 is attached around the rotor or on the rotating shaft of the DC motor 31Y (31M, 31C, or 31B).

An FG-signal as an encoder pulse is output from the FG-signal generation circuit 70Y including a magnetoresistive element (MR element) 71 disposed adjacent to the magnet encoder 36Y. A PG-signal is superposed on this FG-signal.

As shown in FIG. 4, the magnet encoder 36Y is formed by alternately aligning S and N poles. The widths of S and N poles at one portion are different at, e.g., 80:20, whereas those of S and N poles at another portion are the same at, e.g., 50:50.

As shown in FIG. 5, the FG-signal generation circuit 70Y is made up of the magnetoresistive element 71, an amplifier 72, and a comparator 73.

As encoder electrodes opposing the element 71 alternately change between S and N poles along with rotation of the magnet encoder 36Y, the magneto-resistive element 71 converts the change into an electrical signal.

The amplifier 72 amplifies the electrical signal from the magnetoresistive element 71.

The comparator 73 outputs an FG-signal as a digital encoded pulse on the basis of the electrical signal from the amplifier 72, as shown in FIGS. 6 and 7A.

The Y-FG-signal is a pulse having a duty ratio of 1:1 for a normal electrode portion, and a pulse having a duty ratio of 8:2 for a portion at which the widths of S and N poles are different.

The Y-FG-signal from the FG-signal generation circuit 70Y is supplied to the PG-signal detection circuit 74Y.

The PG-signal detection circuit 74Y is made up of a timer counter for counting, e.g., the pulse width, a comparator, and the like.

The PG-signal detection circuit 74Y outputs a Y-PG-signal when the duty ratio of the Y-FG-signal from the FG-signal generation circuit 70Y is a predetermined value or less.

For example, when the duty ratio of the Y-FG-signal is 30% or less, as shown in FIG. 7A, the PG-signal detection circuit 74Y outputs a Y-PG-signal.

While the magnet encoder 36Y rotates once, i.e., the photosensitive drum 21Y rotates once, the FG-signal generation circuit 70Y outputs a Y-FG-signal of 600 pulses. Every time the magnet encoder 36Y rotates once, i.e., the photosensitive drum 21Y rotates once, the PG-signal detection circuit 74Y outputs a Y-PG-signal.

Magnet encoders 36M, 36C, and 36B are also attached around the rotors or on the rotating shafts of the DC motors 31M, 31C, and 31B. The FG-signal generation circuits 70M, 70C, and 70B, and the PG-signal detection circuits 74M, 74C, and 74B are also arranged. While the photosensitive drums 21M, 21C, and 21B rotate once in the same manner as described above, the FG-signal generation circuits 70M, 70C, and 70B output M-FG-, C-FG-, and B-FG-signals of 600 pulses each. The PG-signal detection circuits 74M, 74C, and 74B output M-PG-, C-PG-, and B-PG-signals every rotation.

The motor control circuits 35Y, 35M, 35C, and 35B control to rotate the DC motors 31Y, 31M, 31C, and 31B at the same peripheral speed. Thus, the photosensitive drums 21Y, 21M, 21C, and 21B rotate at the same peripheral speed.

The FG-signal generation circuits 70Y, 70M, 70C, and 70B except for the magnet encoders, and the PG-signal detection circuits 74Y, 74M, 74C, and 74B may be arranged inside the control ASIC of the control circuit 33 or outside the control ASIC of the control circuit 33.

In the above example, a signal from the magnet encoder 36Y (36M, 36C, or 36B) is converted into a digital signal to detect a PG-signal. Alternatively, the PG-signal may be detected by an analog signal from the magnet encoder 36Y (36M, 36C, or 36B).

In this case, as shown in FIG. 8, an analog signal (FG-signal) from the amplifier 72 of the FG-signal generation circuit 70Y (70M, 70C, or 70B) is output to a PG-signal detection circuit 74Y' (74M', 74C', or 74B'). The PG-signal detection circuit 74Y' (74M', 74C', or 74B') is formed from a high-pass filter having a characteristic shown in FIG. 9.

When the frequency of an FG-signal is higher than a predetermined frequency (fp) shown in FIG. 10A, the PG-signal detection circuit 74Y' (74M', 74C', or 74B') outputs a PG-signal, as shown in FIG. 10B.

As a method of detecting a PG-signal, a signal from a phase controller (APC) 43 (to be described later) may be used.

Figure 11:
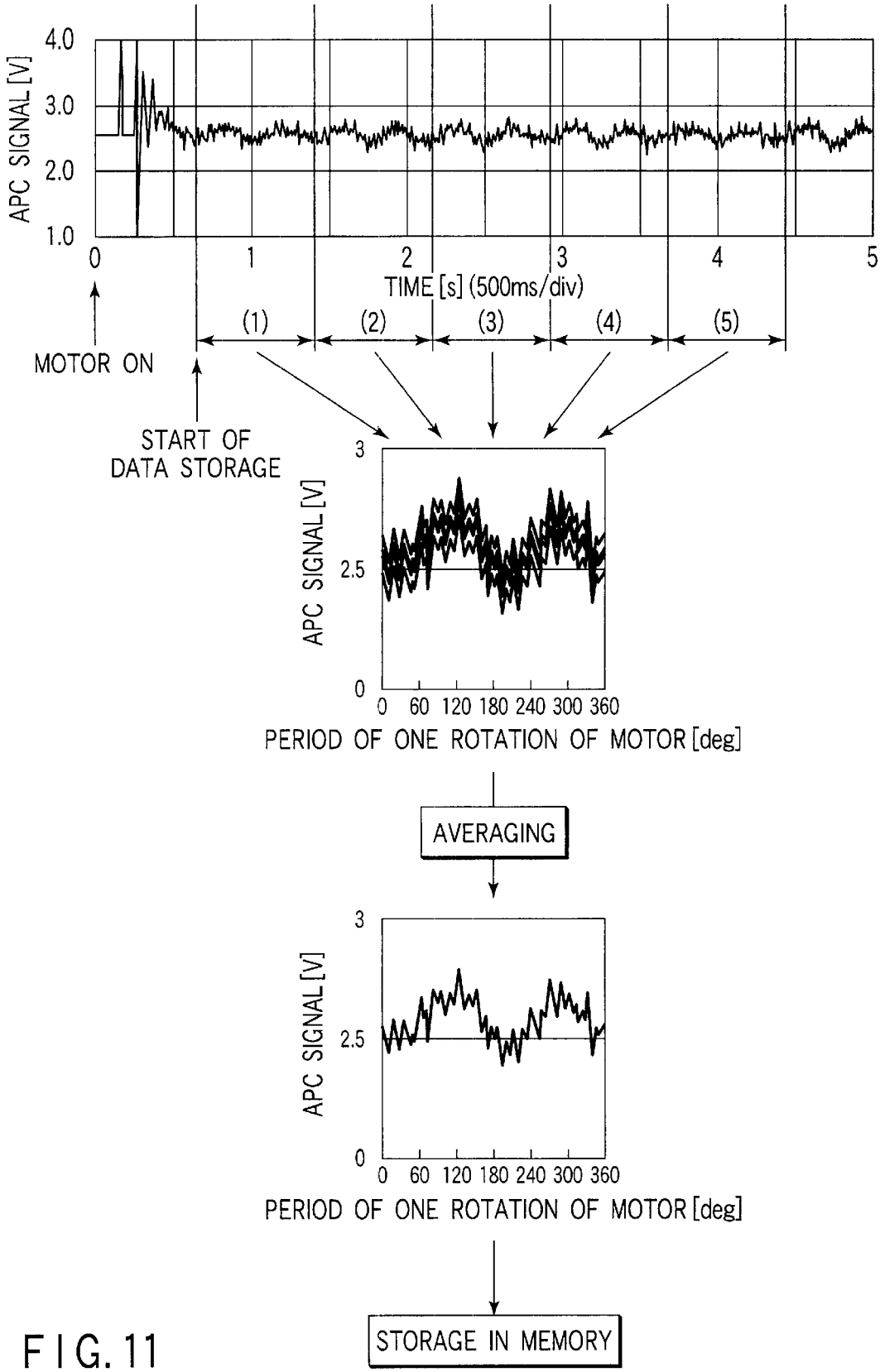
FIGS. 11 and 12 are views for explaining a PG-signal detection method based on an APC signal from a phase controller.
Figure 12:
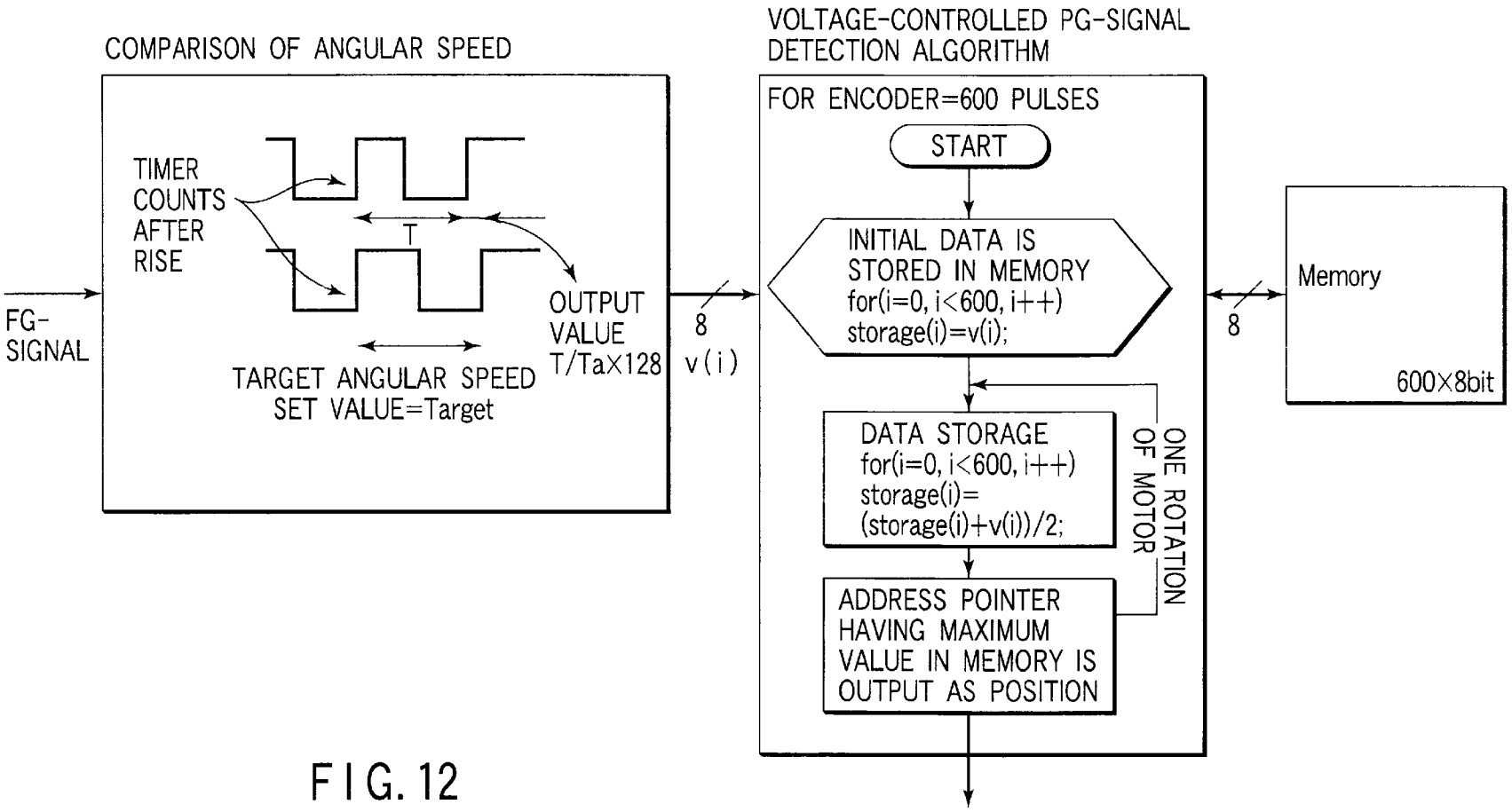

In this case, the FG-signal generation circuit 70Y (70M, 70C, or 70B) generates a 600-pulse FG-signal every time the DC motor 31Y (31M, 31C, or 31B). The FG-signal is supplied to the PG-signal detection circuit 74Y. As shown in FIGS. 11 and 12, a timer counter (not shown) start measuring the width (duration) of the FG-signal, at the leading edge thereof. The width of the FG-signal is compared with a target width that corresponds to a target angular speed. The difference between the width of the FG-signal and the target width is output in the form of 8-bit voltage data.

In a voltage-controlled PG-signal detection block (algorithm), only the first input FG-signal data is copied as initial data to a memory (not shown) for one rotation of the motor. From the second rotation of the DC motor 31Y (31M, 31C, or 31B), input data and memory data are averaged, and the average value is stored in the original memory. Data are stored in the memory as average values by the number of motor rotations. As an output, an address pointer having the maximum value in the memory is output as a reference phase.

Figure 3:
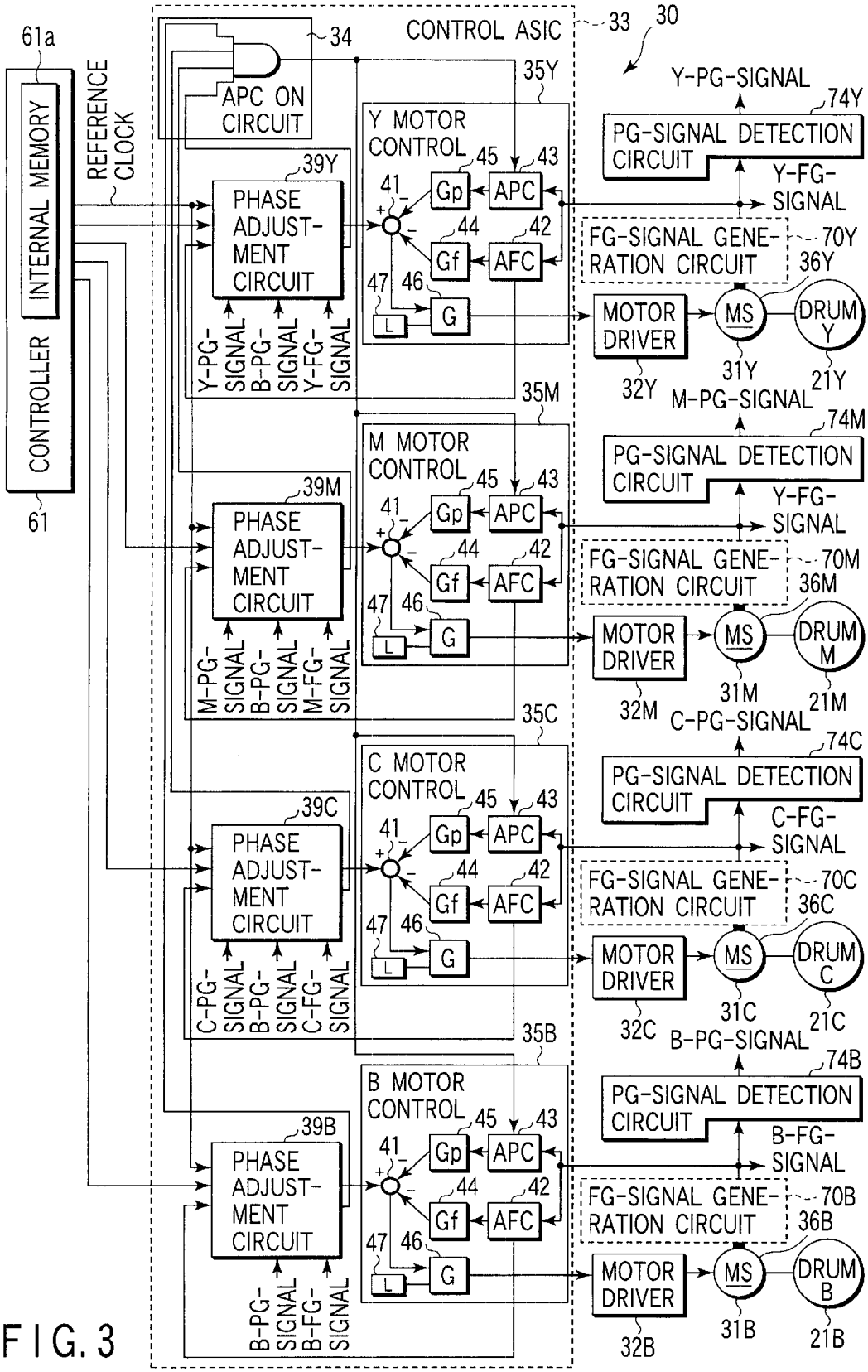
FIG. 3 is a block diagram showing the schematic arrangement of a motor controller.

As shown in FIG. 3, each of the motor control circuits 35Y, 35M, 35C, and 35B is comprised of an adder/subtracter 41, speed controller (AFC) 42, phase controller (APC) 43, amplifier (Gf) 44, amplifier (Gp) 45, amplifier (G) 46, and limitter (L) 47.

The adder/subtracter 41 adds a clock signal from a phase adjustment circuit (52Y, 52M, 52C, or 52B), and subtracts the clock signal in accordance with a signal from the amplifier (Gf) 44 or amplifier (Gp) 45.

The speed controller (AFC) 42 outputs a signal based on an FG-signal from a magnetoresistive element (37Y, 37M,. 37C, or 37B).

The phase controller (APC) 43 outputs a signal based on an FG-signal from the magnetoresistive element (37Y, 37M, 37C, or 37B).

The amplifier (Gf) 44 amplifies a signal from the speed controller (AFC) 42.

The amplifier (Gp) 45 amplifies a signal from the phase controller (APC) 43.

The amplifier (G) 46 amplifies a signal from the adder/subtracter 41.

The limitter (L) 47 is connected to the amplifier (G) 46 to limit the amplification factor of the amplifier (G) 46. In adjusting the phase by the phase adjustment circuit (52Y, 52M, 52C, or 52B), the limitter (L) 47 is turned on to gradually accelerate or decelerate the DC motor without any maximum acceleration or maximum deceleration. The ON/OFF state of the limitter (L) 47 is switched by a signal from the controller 61.

The motor control circuits 35Y, 35M, 35C, and 35B receive a reference clock generated by loading a target angular speed set value to the register of the controller (CPU) 61 for controlling the whole color digital copying apparatus 1. Further, the motor control circuits 35Y, 35M, 35C, and 35B receive FG-signals as encoder pulses from the magneto-resistive elements 37Y, 37M, 37C, and 37B. The motor control circuits 35Y, 35M, 35C, and 35B receive an APC ON signal from the APC ON circuit 34.

The motor control circuits 35Y, 35M, 35C, and 35B output lock signals when speeds by their speed controllers (AFCs) 42 fall within a given range (target angular speed set value ±0.125%) with respect to the target angular speed set value.

The motor control circuits 35Y, 35M, 35C, and 35B output, to the motor drivers 32Y, 32M, 32C, and 32B, signals for accelerating or decelerating the DC motors 31Y, 31M, 31C, and 31B using their speed controllers (AFCs) 42 so as to match the frequency of a reference clock from the controller 61 with the frequencies of FG-signals as encoder pulses from the magnetoresistive elements 37Y, 37M, 37C, and 37B when the power supply is turned on (motor is activated).

The speed controllers (AFCs) 42 of the motor control circuits 35Y, 35M, 35C, and 35B output, to the motor drivers 32Y, 32M, 32C, and 32B, signals for accelerating or decelerating the DC motors 31Y, 31M, 31C, and 31B so as to match the frequency of the reference clock from the controller 61 with the frequencies of FG-signals as encoder pulses from the magnetoresistive elements 37Y, 37M, 37C, and 37B.

The phase controllers (APCs) 43 of the motor control circuits 35Y, 35M, 35C, and 35B control to match the frequency of the reference clock from the controller 61 with the 1-pulse phases of the frequencies of FG-signals as encoder pulses from the magnetoresistive elements 37Y, 37M, 37C, and 37B upon reception of an APC ON signal from the APC ON circuit 34.

The APC ON circuit 34 is formed from an AND circuit. The APC ON circuit 34 outputs an APC ON signal to the phase controllers (APCs) 43 of the motor control circuits 35Y, 35M, 35C, and 35B upon reception of phase lock signals from the phase adjustment circuits 39Y, 39M, 39C, and 39B.

Figure 13:
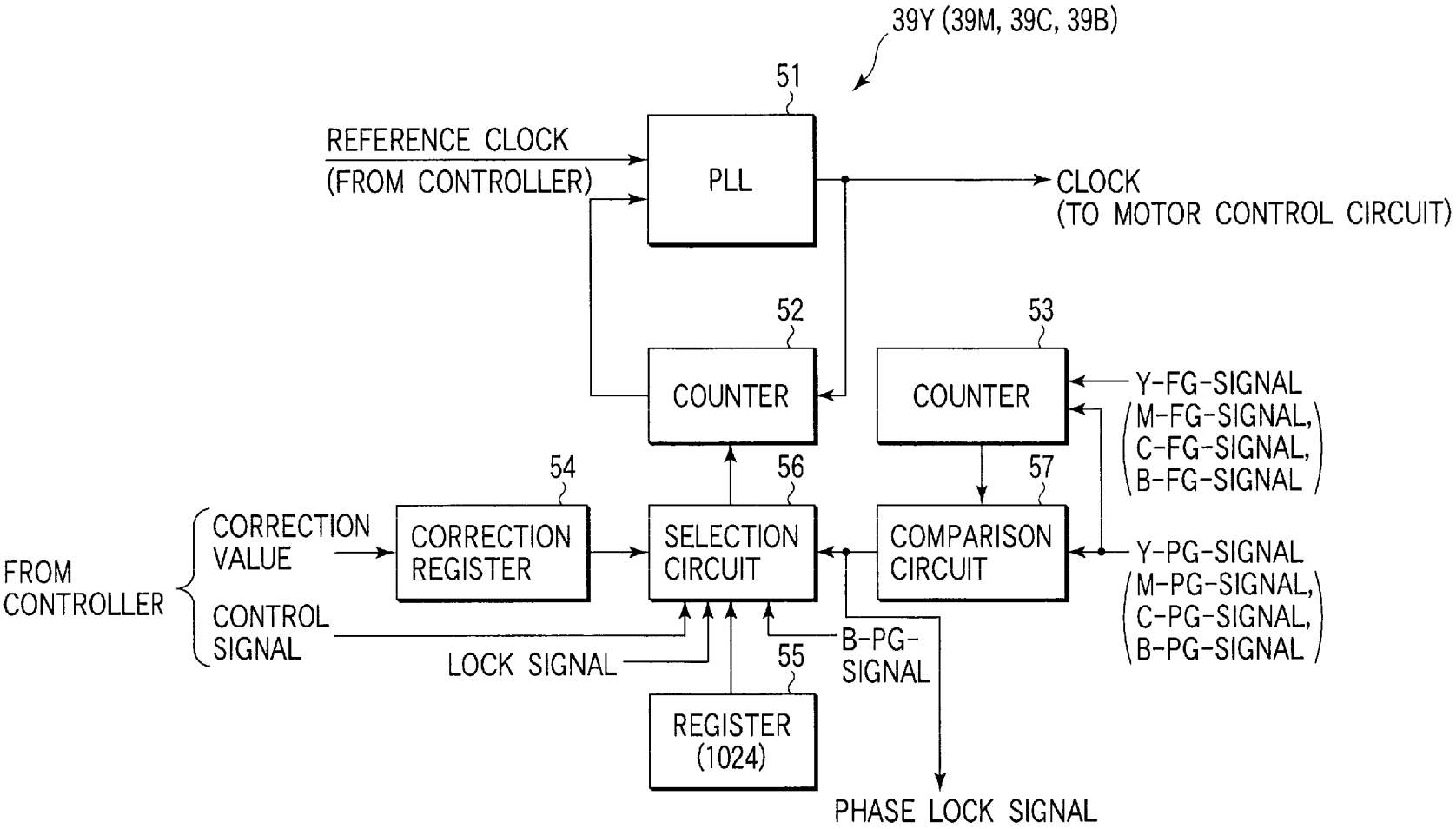
FIG. 13 is a block diagram showing the schematic arrangement of a phase adjustment circuit.

As shown in FIG. 13, the phase adjustment circuit 39Y (39M, 39C, or 39B) comprises a PLL circuit 51, counters 52 and 53, correction register 54, register 55, selection circuit 56, and comparison circuit 57. The PLL circuit 51 and counter 52 form a frequency division circuit.

The PLL circuit 51 receives a reference clock from the controller 61, and a count-up output from the counter 52. The counter 52 has a count value selected by the selection circuit 56 in advance, counts clocks output from the PLL circuit 51, and when the count value reaches the set count value, outputs a count-up output.

The PLL circuit 51 is a pre-scaler using a PLL, and divides the reference clock with a good system. By setting "1000" in the counter 52, the PLL circuit 51 divides the reference clock at a frequency division ratio of "1000/1024".

The counter 53 counts Y-FG-signals output from the FG-signal generation circuit 70Y every time the PG-signal detection circuit 74Y outputs a Y-PG-signal. This count value is supplied to the comparison circuit 57.

The correction register 54 has a correction count value based on a phase difference from the controller 61 in advance.

The register 55 stores a count value of "1024" to be set in the counter 52. This count value is set in the counter 53 in directly outputting a supplied reference clock from the PLL circuit 51.

The selection circuit 56 outputs a correction count value from the correction register 54 or a count value from the register 55 to the counter 52 on the basis of a Y-PG-signal as a reference phase signal from the PG-signal detection circuit 74Y, a control signal from the controller 61, an output signal from the comparison circuit 57, and a lock signal from the motor control circuit 35Y.

More specifically, after a lock signal from the motor control circuit 35Y is supplied, a correction count value from the correction register 54 is selected and output to the counter 52 in accordance with a Y-PG-signal from the PG-signal detection circuit 74Y. When a control signal from the controller 61 and an output signal from the comparison circuit 57 are supplied, a count value from the register 55 is selected and output to the counter 52.

The comparison circuit 57 compares the count value of the counter 53 with an allowable range centered on a predetermined count value (1024) every time a Y-PG-signal from the PG-signal detection circuit 74Y is supplied. If the count value falls within the allowable range as a result of comparison, the comparison circuit 57 supplies a switching signal to the selection circuit 56, and a phase lock signal to the APC ON circuit 34.

How the relative phases of the four photosensitive drums 21Y, 21M, 21C and 21B (i.e., phases of the peripheral-speed variations of the drums) will be described below.

Figure 14:
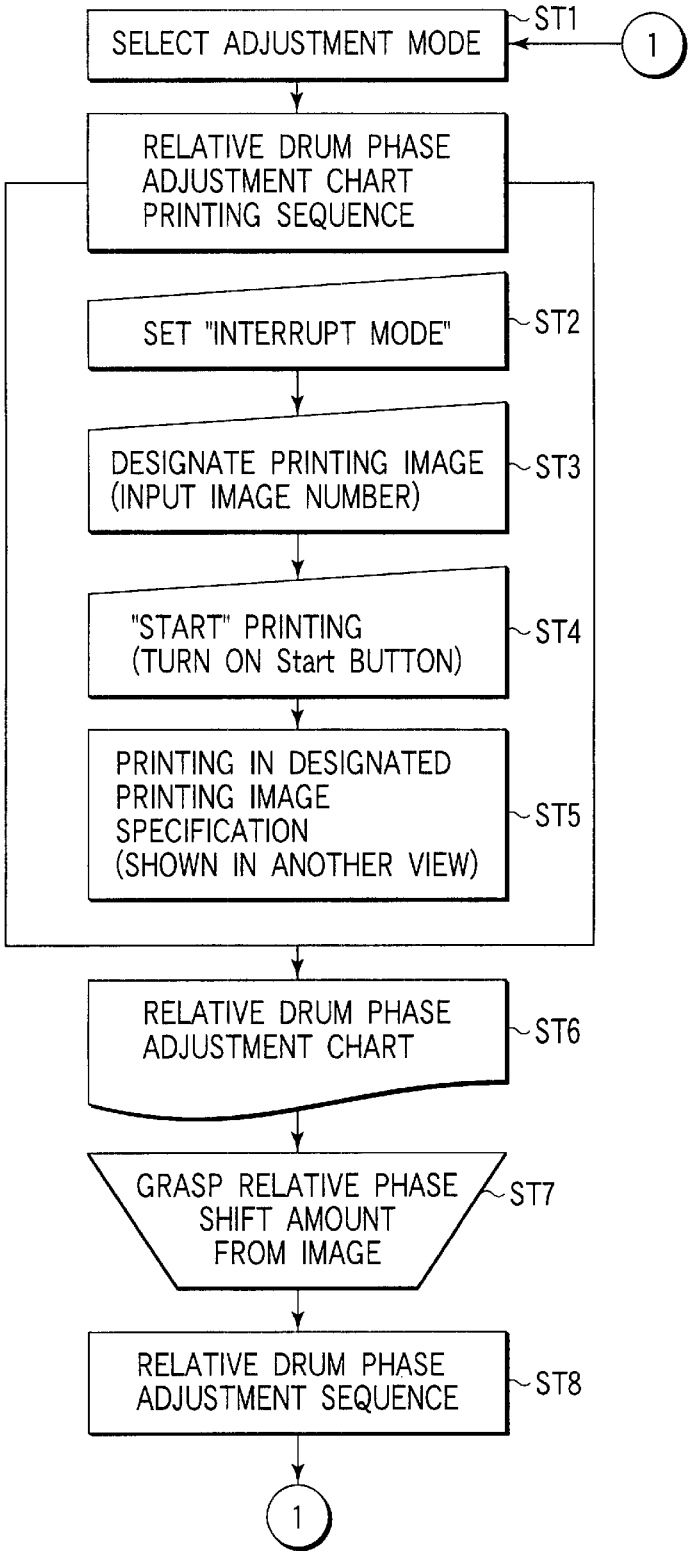
FIG. 14 is a flow chart for explaining manual adjustment processing for the relative phases of photosensitive drums.

First, it will be explained how to adjust the relative phases manually, with reference to the flow chart of FIG. 14.

The operator uses the operation panel 64 to select an adjustment mode for the phase periods of peripheral speed variations of the photosensitive drums 21Y, 21M, 21C, and 21B (ST1). By this selection, the initial window of the adjustment mode is displayed using the operation panel 64 (ST1).

The operator sets an interrupt mode using the operation panel 64 (ST2), inputs an image number to designate a printing image (ST3), and turns a printing start button on (ST4).

Then, printing of a self-printing image pattern is designated as a relative phase adjustment chart.

The controller 61 reads out a self-printing image pattern for recognizing the phase of a rotational angle variation that is registered in the internal memory 61*a*. The exposure device 5 is driven on the basis of this pattern to form electrostatic latent images corresponding to the pattern on the photosensitive drums 21Y, 21M, 21C, and 21B. A sheet P is picked up from the sheet cassette 8*a* or 8*b*, and conveyed to the transfer belt 6 via the sheet convey portion 10. The electrostatic latent images on the photosensitive drums 21Y, 21M, 21C, and 21B are developed with corresponding color toners, and transferred to the sheet P on the transfer belt 6 by the transfer devices 26Y, 26M, 26C, and 26B.

The developer images of the pattern are fixed by the fixing device 7, and the sheet P is discharged as a reference phase adjustment chart (ST5).

Figure 15:
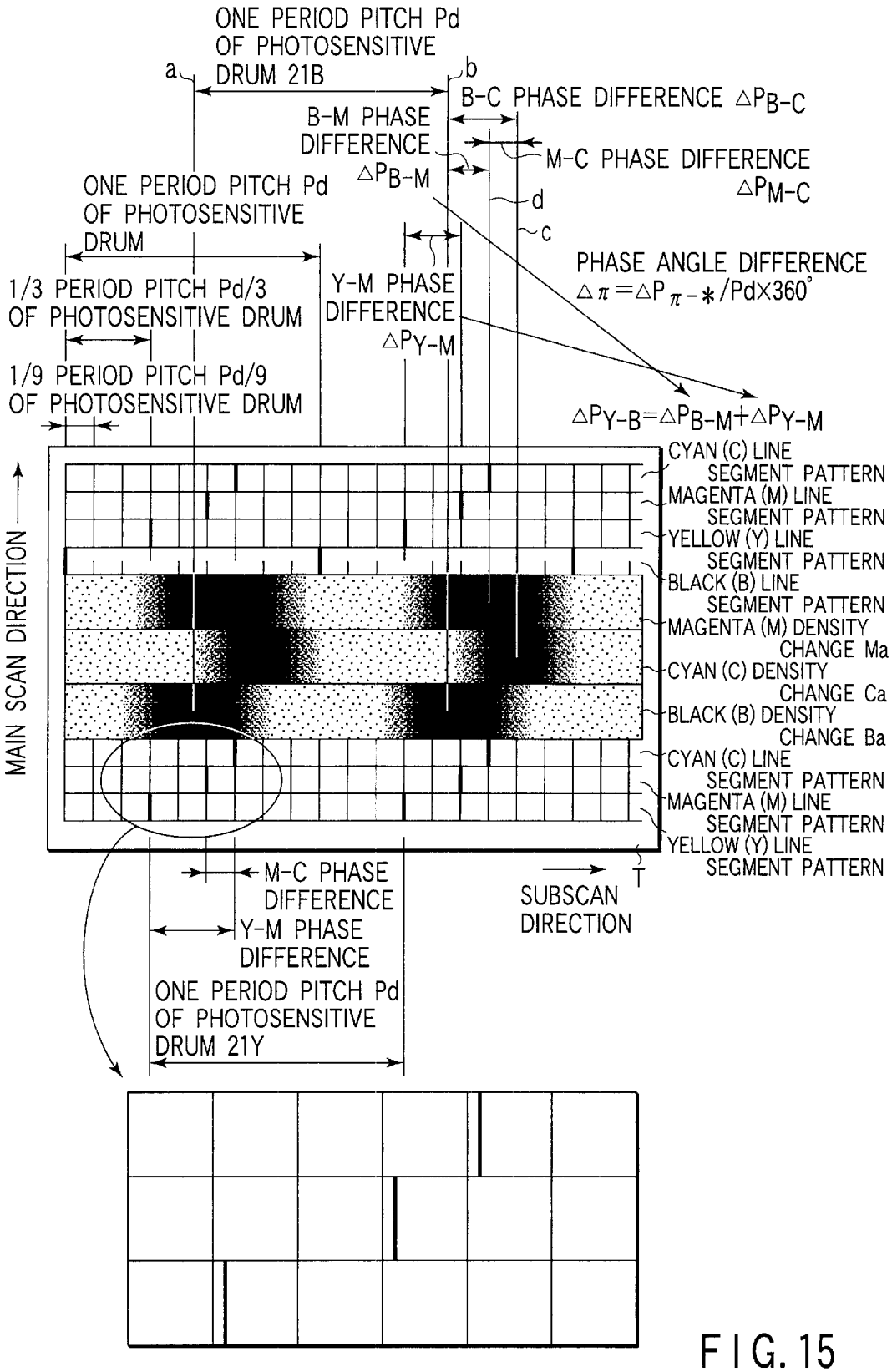
FIGS. 15 and 16 are views for explaining an adjustment chart before relative phase adjustment processing.

As the self-printing image pattern (relative phase adjustment chart), as shown in FIG. 15, uniform-density halftone bands Ma, Ca, and Ba alternated in units of magenta (M), cyan (C), and black (B) in a direction parallel to the moving direction of the transfer belt 6, i.e., the subscan direction of the sheet P, and line segment patterns of magenta (M), cyan (C), yellow (Y), and black (B) at a predetermined period are printed.

The halftone image is an image which is drawn by 2-pixel modulation at a density of 20 to 30% and allows easily recognizing rotational variations.

As seen from by the halftone bands Ma, Ca, and Ba shown in FIG. 15, density changes in halftone as the peripheral speeds of the photosensitive drums 21Y, 21M, 21C, and 21B vary.

More specifically, speed variations are represented by the color density depending on the pixel density. The speed is low at a dark portion, and high at a light (faint) portion.

A position shift in the subscan direction from a dark portion to a dark portion or from a light portion to a light portion between the respective colors corresponds to a phase difference in speed variations (phase difference in angular variations).

The fourth line from the top in FIG. 15 is a scale representing one period pitch, ⅓ period pitch, and ⅙ period pitch of the photosensitive drum 21B. The fourth line represents line segments of the photosensitive drum 21B in the main scan direction, i.e., a black (B) line segment pattern. With this scale, the phase difference angle between halftone bands can be grasped.

The first and third lines from the top in FIG. 15 represent line segments of the photosensitive drum 21C in the main scan direction. These lines form a line-segment pattern composed a cyan (C) line and a black (B) line which overlap each other.

The second line from the top and the second line from the bottom, shown in FIG. 15, represent line segments of the drum 21M in the main scan direction. These lines constitute a line-segment pattern composed of a magenta (M) line and a black (B) line that overlap each other.

The third line from the top, shown in FIG. 15, represents a line segment of the drum 21Y in the main scan direction. This line constitutes a line-segment pattern composed of a yellow (Y) line and a black (B) line that overlap each other.

As for a color which hardly changes in density (color whose density is difficult to identify), the position shift in the subscan direction and the phase difference in speed variations are determined based on the line segment patterns of the respective colors.

That is, a light color such as yellow (Y) is difficult to identify its density. The interval in the subscan direction from a portion where misregistration of yellow (Y) maximizes to a portion where misregistration of magenta (M) or cyan (C) maximizes is obtained from a line segment formed by overlapping for line segments of black (B) drawn on two end sides in the vertical direction and a line segment of another color (magenta (M) or cyan (C)). Then, the phase differences of black, and magenta (M) or cyan (C) obtained from halftone images are added (or subtracted). By this indirect method, the phase difference of yellow (Y) in rotational variations from black (B) serving as a reference color is grasped. (See FIG. 16, which is a magnified view.)

The position shifts of magenta (M) and cyan (C) in the subscan direction, and their phase differences in speed variations are determined from the densities of the halftone bands with respect to black (B). The phase difference of magenta (M) or cyan (C) based on line segments is determined with reference to the scale representing one rotational period, ⅓ period, and ⅙ period of the photosensitive drum 21B immediately above the halftone bands. The phase difference between yellow (Y) and black (B) is determined based on the phase difference between magenta (M) or cyan (C), and black (B).

In other words, the phase differences of ground colors (magenta (M), cyan (C), and yellow (Y)) are recognized on the basis of black (B). The phase difference between reference black (B) and yellow (Y) as a light color whose density is difficult to identify is grasped by the indirect method.

Figure 16:
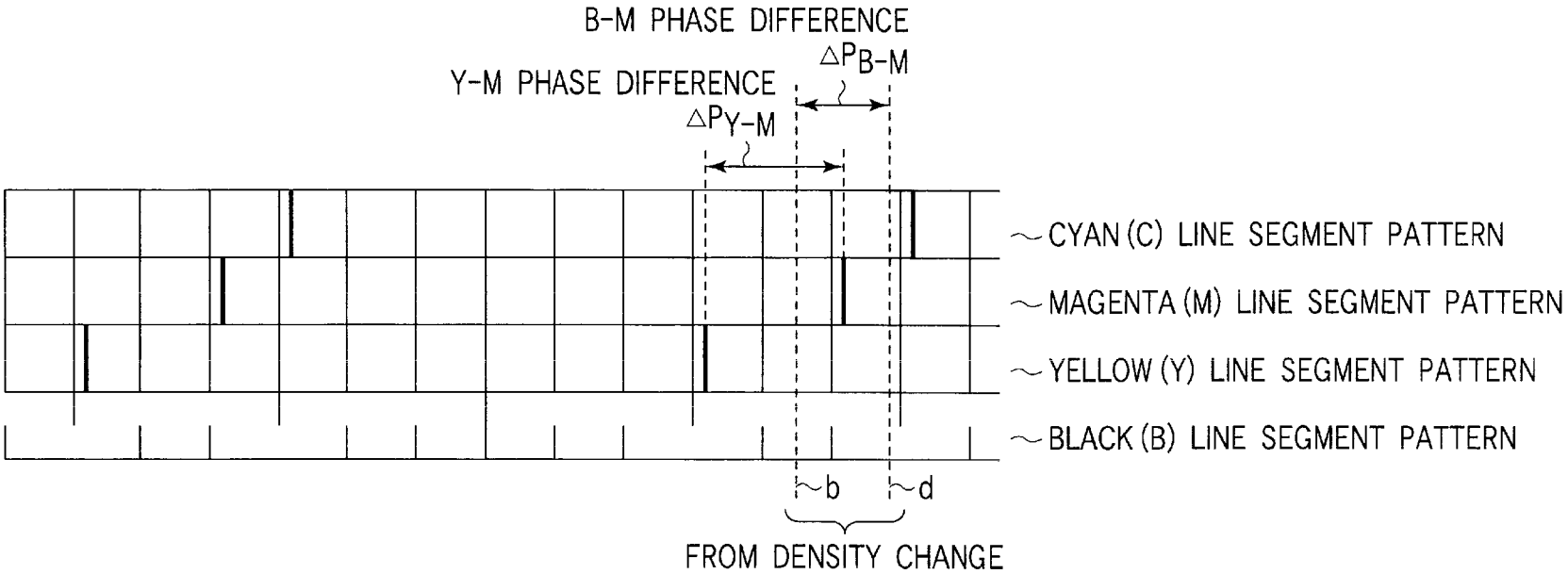

In the relative phase adjustment chart of FIGS. 15 and 16, an interval from a dark portion a to a dark portion b is determined as one period pitch Pd serving as one rotational period of the photosensitive drum 21B in black (B) on the basis of the density of the black (B) halftone band Ba.

A phase difference $\Delta P_{B-C}$ of cyan (C) from black (B) is determined from a right side b of one period pitch Pd and a dark portion c of the cyan (C) halftone band Ca.

A phase difference $\Delta P_{M-C}$ of magenta (M) from cyan (C) is determined from the dark portion c of the cyan (C) halftone band Ca and a dark portion d of the magenta (M) halftone band Ma.

A phase difference $\Delta P_{B-M}$ of magenta (M) from black (B) is determined from the right side b of one period pitch Pd and the dark portion d of the magenta (M) halftone band Ma.

A phase difference $\Delta P_{Y-M}$ of magenta (M) from yellow (Y) is determined from a magenta (M) line segment pattern on the second line from the top and a yellow (Y) line segment pattern on the third line from the top.

The phase difference $\Delta P_{Y-M}$ of magenta (M) from yellow (Y) and the phase difference $\Delta P_{B-M}$ of magenta (M) from black (B) are added to determine a phase difference APY-B of black (B) from yellow (Y):

$$\Delta P_{Y-B}=\Delta P_{B-M}+\Delta P_{Y-M}$$

where a phase angle difference ($\Delta\pi$) is a value calculated by dividing the phase difference ($\Delta P_{\#-X}$) by one period pitch (Pd) of the photosensitive drum, and multiplying the quotient by 360°:

$$\text{Phase Angle Difference } \Delta\pi=(\Delta P_{\#-X}/\text{Pd})\times 360°$$

where $\Delta P_{\#-X}$ is $\Delta P_{B-C}$, $\Delta P_{B-M}$, $\Delta P_{Y-B}$, $\Delta P_{Y-M}$, and $\Delta P_{M-C}$.

A relative phase shift amount from an image is grasped on the basis of the printed relative phase adjustment chart (ST6 and ST7).

As for the phase angle difference of cyan (C) from black (B), the phase difference $\Delta P_{B-C}$ of cyan (C) from black (B) is determined as 2.5 pitches from the right side b of one period pitch Pd and the dark portion c of the cyan (C) halftone band Ca. Further, one period pitch Pd is determined as 9 pitches.

From this, a lagged phase of 2.5 ($\Delta P_{B-C}$)×360°/9=100° is determined.

As for the phase angle difference of magenta (M) from black (B), the phase difference $\Delta P_{B-M}$ of magenta (M) from black (B) is determined as 1 to 1.5 pitches from the right side b of one period pitch Pd and the dark portion d of the magenta (M) halftone band Ma.

From this, a lagged phase of 1 to 1.5 ($\Delta P_{B-M}$)×360°/9=40° to 50°≈45° is determined.

For magenta (M) from yellow (Y), the phase difference $\Delta P_{Y-M}$ of magenta (M) from yellow (Y) is determined as 2 pitches from the magenta (M) line segment pattern on the second line from the top and a yellow (Y) line segment pattern from the top.

From this, a leading phase of 2.0 ($\Delta P_{Y-M}$)×360°/9=80° is determined.

Hence, the phase angle difference of yellow (Y) from black (B) is determined as a leading phase of 35° (or a lagged phase of 45°) by adding the phase angle difference (leading phase of 80°) of magenta (M) from yellow (Y) and the phase angle difference (lagged phase of about 325°) of magenta (M) from black (B).

Figure 17:
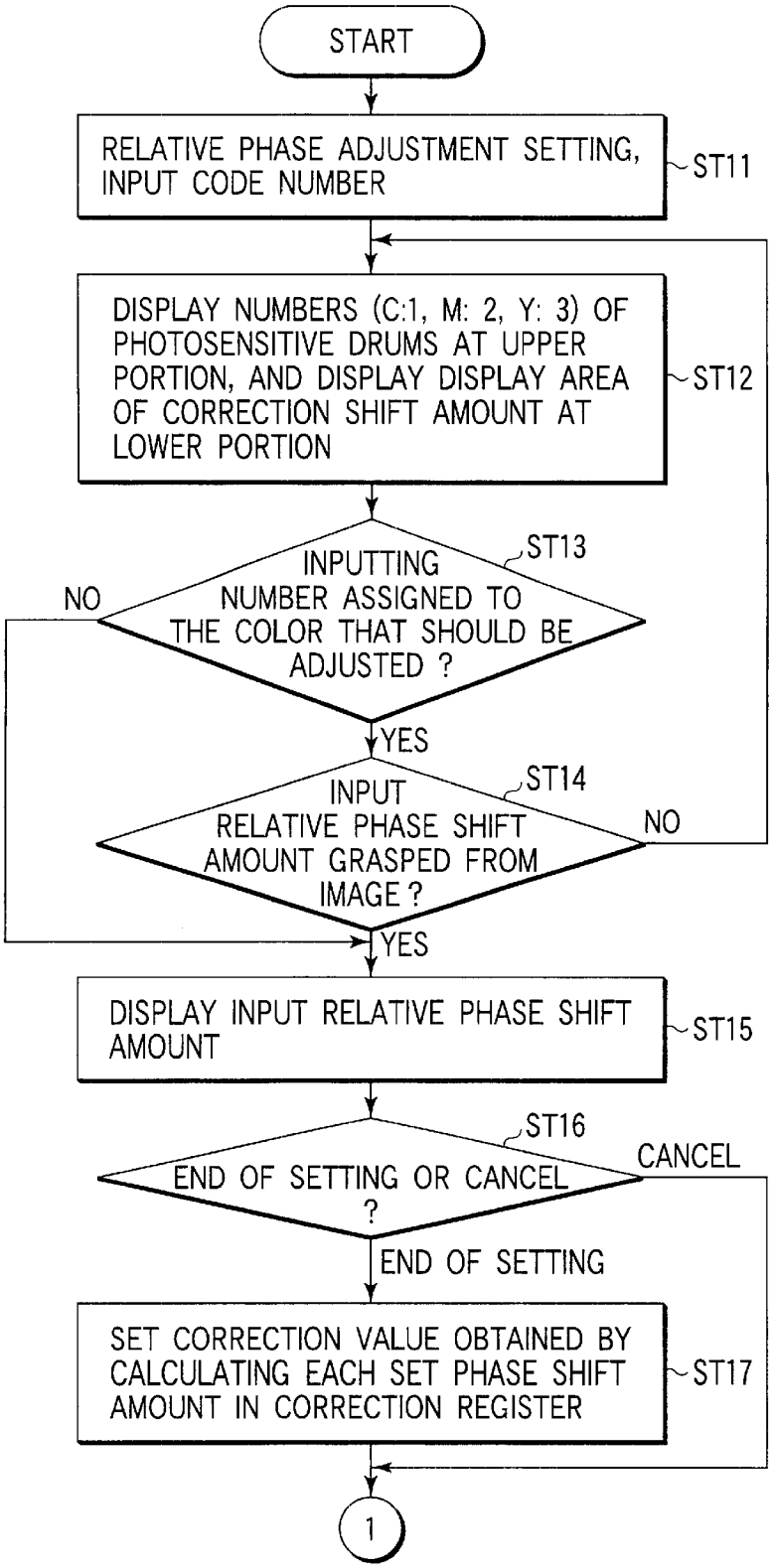
FIGS. 17, 18, and 19 are flow charts for explaining manual adjustment processing for the relative phases of the photosensitive drums.

Thereafter, the apparatus 1 enters the sequence of adjusting the relative phases (ST8). The sequence of adjusting the relative phases will be described, with reference-to the flow chart of FIG. 17.

First, the operator operates the operation panel 64, inputting a code number that designates the adjustment of relative phases (ST11). The controller 61 displays the numbers assigned to the colors (photosensitive drums), C: 1, M: 2, Y: 3) at the upper part of the display provided on the panel 64, and also displays a correction shift amount at the lower part of the display (ST12).

Then, the operator operates the panel 64, inputting the number assigned to the color that should be adjusted (ST13) and the relative phase shift he has grasped from the image (ST14). The phase shifts the three colors have with respect to the rotation phase reference for black are thereby set.

For example, phase shifts "100," "45" and "325" are input for C(1), M(2) and Y(3), respectively. Then, the operation returns to Step 12, in which the phase shifts "100," "45" and "325" are displayed at the lower part of the display, for "(C: 1, M: 2, Y: 3)" that is displayed at the upper part of the display.

If the operator inputs the end of setting using the operation panel 64, the controller 61 converts the respective set phase shift amounts into calculated correction values, and sets the correction values in the correction registers 54 of the corresponding phase adjustment circuits 39Y, 39M, 39C, and 39B (ST16).

For a delay of 100° for cyan (C), "about 1308" is calculated from "1024+100×(1024/360)", and set in the correction register 54 of the phase adjustment circuit 39C.

For a delay of 45° for magenta (M), "about 1152" is calculated from "1024+45×(1024/360)", and set in the correction register 54 of the phase adjustment circuit 39M.

For a delay of 325° for yellow (Y), "about 1436" is calculated from "1024+325×(1024/360)", and set in the correction register 54 of the phase adjustment circuit 39Y.

If the operator inputs "cancel" in step 15, or setting processing ends in step 16, the flow returns to the initial window of the adjustment mode in step 1.

To decrease the number of setting steps, this sequence may output and instruct a self-printing image for grasping a phase shift. Self-printing operation is executed to reconfirm a phase shift from a printed image (chart), and check whether the phase must be readjusted. If necessary, the phase is readjusted by a value corresponding to a phase shift amount obtained from a re-output image.

Figure 18:
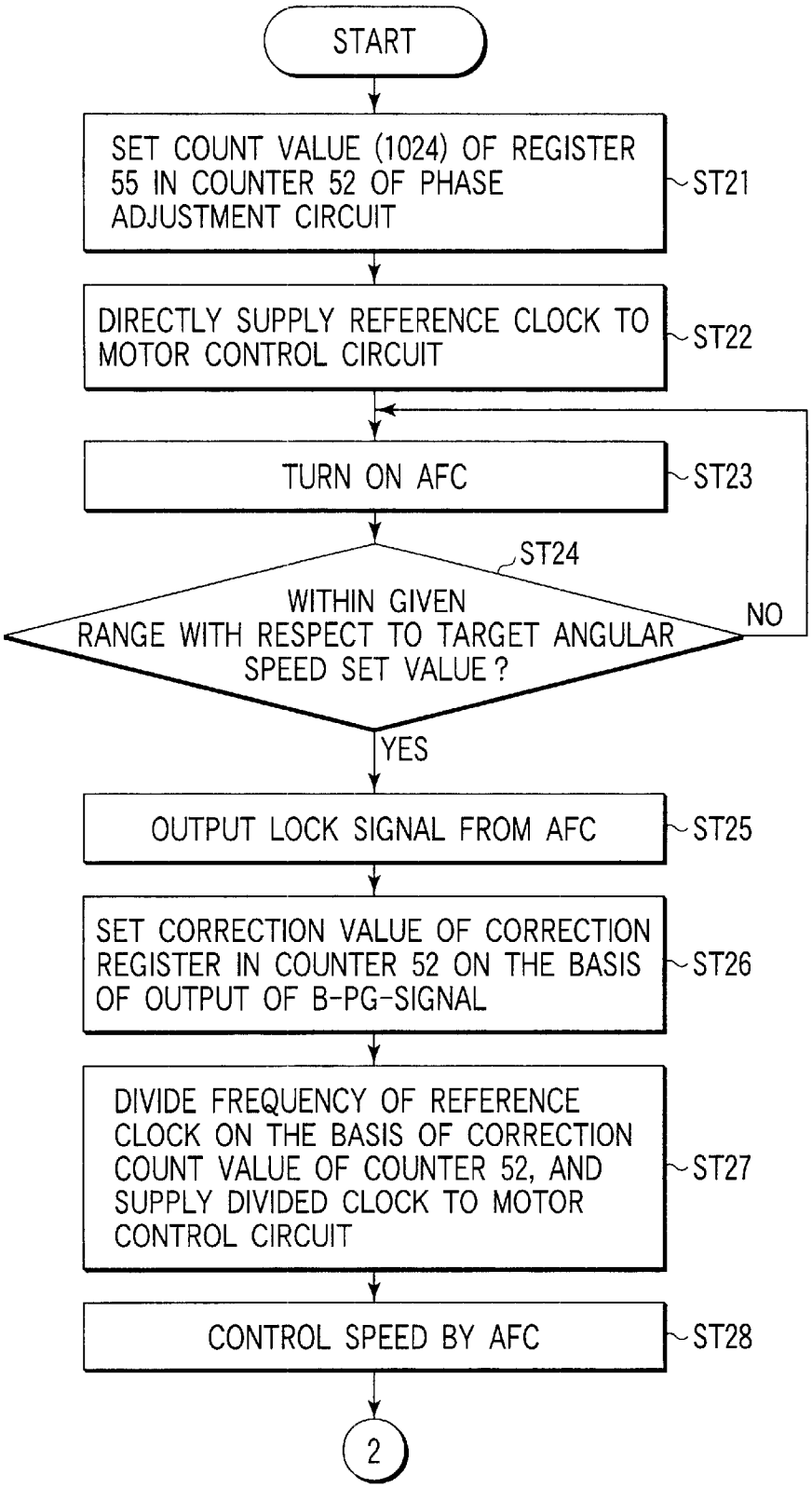
Figure 19:
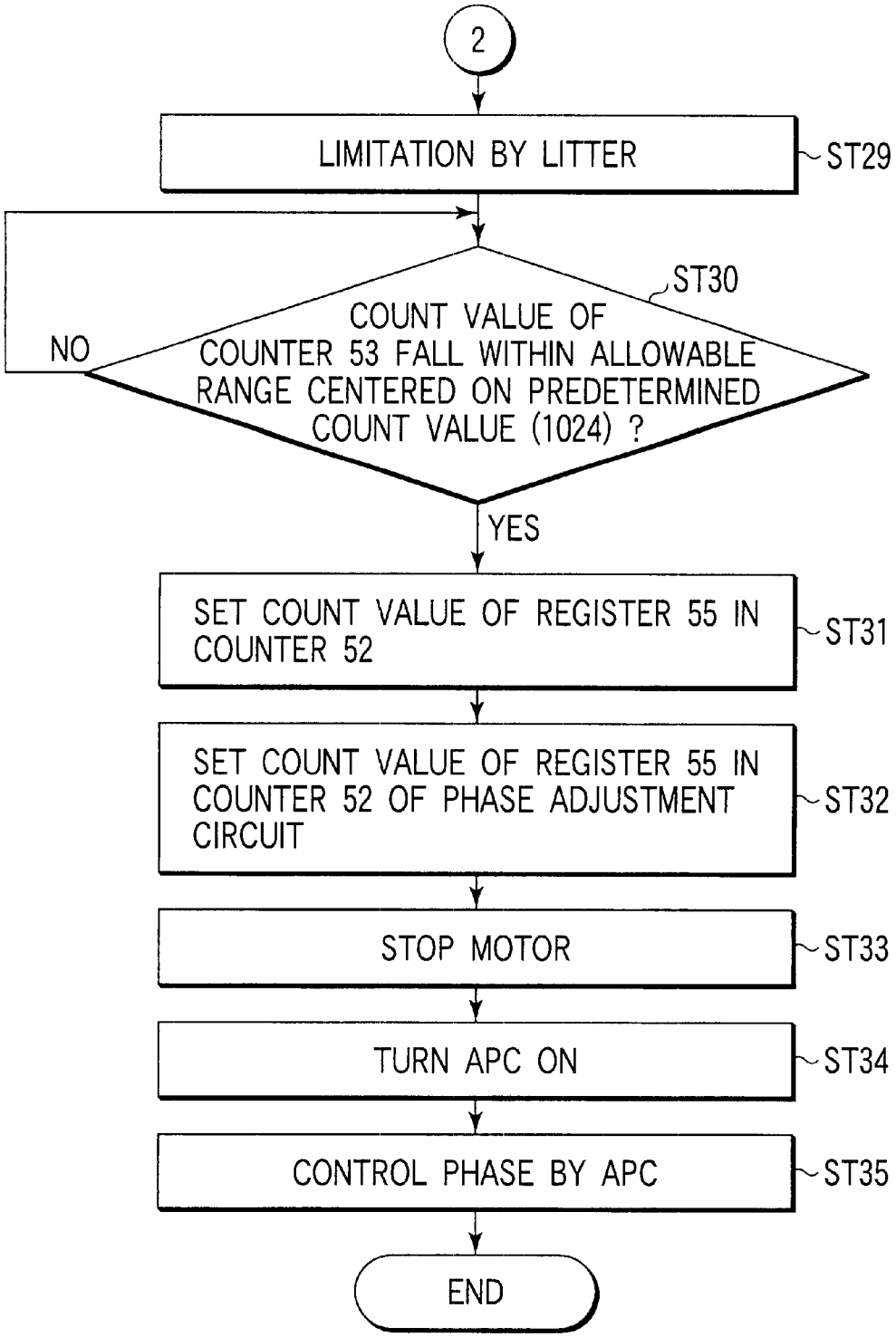

DC motor positioning control processing at a timing at which the DC motors 31Y, 31M, 31C, and 31B start in power ON operation or copying/printing operation of the color image forming apparatus 1 while a correction value attained by calculating each phase shift amount is set will be described with reference to flow charts shown in FIGS. 18 and 19 and timing charts shown in FIGS. 20A to 20H.

More specifically, in activating the motor, e.g., in power-on, the controller 61 outputs a control signal to the selection circuits 56 of the phase adjustment circuits 39Y, 39M, 39C, and 39B, thereby setting the count values (1024) of the registers 55 in the counters 52 (ST21).

A reference clock from the controller 61 is directly supplied to the motor control circuits 35Y, 35M, 35C, and 35B via the phase adjustment circuits 39Y, 39M, 39C, and 39B (ST22).

The motor control circuits 35Y, 35M, 35C, and 35B output, to the motor drivers 32Y, 32M, 32C, and 32B, signals for accelerating or decelerating the DC motors 31Y, 31M, 31C, and 31B using their speed controllers (AFCs) 42 so as to match the frequency of the reference clock from the controller 61 with the frequencies of FG-signals as encoder pulses from the FG-signal generation circuits 70Y, 70M, 70C, and 70B by the magnetoresistive elements 37Y, 37M, 37C, and 37B (ST23). The DC motors 31Y, 31M, 31C, and 31B are accelerated or decelerated to come close to a target angular speed set value.

If speeds by the speed controllers (AFCs) 42 fall within a given range (i.e., target angular speed ±0.125% in the present embodiment) with respect to the target angular speed set values (ST24), the speed controllers (AFCs) 42 output lock signals to the phase adjustment circuits 39Y, 39M, 39C, and 39B (ST25).

If a B-PG-signal from the PG-signal detection circuit 74B is output to the selection circuits 56 of the phase adjustment circuits 39Y, 39M, 39C, and 39B, the selection circuits 56 set the correction values of the correction registers 54 in the counters 52 (ST26). The phase adjustment circuits 39Y, 39M, and 39C are turned on.

The frequency of the reference clock from the controller 61 is divided based on the correction count values of the counters 52 of the phase adjustment circuits 39Y, 39M, 39C, and 39B, and the divided frequencies are supplied to the motor control circuits 35Y, 35M, 35C, and 35B (ST27). At this time, the correction count value of the counter 52 of the phase adjustment circuit 39B is "1024", and the reference clock from the controller 61 is directly supplied to the motor control circuit 35B via the motor control circuit 35B.

The motor control circuits 35Y, 35M, and 35C output, to the motor drivers 32Y, 32M, and 32C, signals for accelerating or decelerating the DC motors 31Y, 31M, and 31C using their speed controllers (AFCs) 42 so as to match the frequencies of clocks from the phase adjustment circuits 39Y, 39M, and 39C with the frequencies of FG-signals as encoder pulses from the FG-signal generation circuits 70Y, 70M, and 70C by the magnetoresistive elements 37Y, 37M, and 37C (ST28). Accordingly, the DC motors 31Y, 31M, and 31C are accelerated or decelerated to come close to their correction values.

The limiter 47 limits the speed to lock the phases gradually, and also changes the pulse width to increase the angular speed of the low-speed motor to 1.1 times the initial speed and the that of the high-speed motor to 0.9 times the initials speed (ST29). This is the technique for minimize the friction between the drums 21Y, 21M and 21C, on the one hand, and the transfer belt 6, on the other, thereby not to shorten the lifetime of the drums 21Y, 21M and 21C or the lifetime of the belt 6.

Every time a Y-PG-signal, M-PG-signal, and C-PG-signal from the PG-signal detection circuits 74Y, 74M, and 74C are supplied, whether the count values of the counters 53 fall within an allowable range centered on a predetermined count value (1024) is checked. If the count values fall within the allowable range as a result of comparison, a switching signal is supplied to the selection circuits 56 (ST30).

The selection circuits 56 which have received the switching signal set the count values of the registers 55 in the counters 52 again (ST31).

If the count values of the registers 55 are set in the respective counters 52 of the phase adjustment circuits 39Y, 39M, and 39C, the phase adjustment circuits 39Y, 39M, and 39C are turned off (ST32).

If no image is subsequently output, the controller 61 stops speed control by the motor control circuits 35Y, 35M, 35C, and 35B, and stops the DC motors 31Y, 31M, 31C, and 31B (ST33).

If an image is subsequently output, the APC ON circuit 34 outputs an APC ON signal to the phase controllers (APCs) 43 of the motor control circuits 35Y, 35M, 35C, and 35B upon reception of phase lock signals from the phase adjustment circuits 39Y, 39M, 39C, and 39B (ST34).

The phase controllers (APCs) 43 of the motor control circuits 35Y, 35M, 35C, and 35B control to match the frequency of the reference clock with the 1-pulse phases of the frequencies of FG-signals as encoder pulses (ST35).

Figure 20:
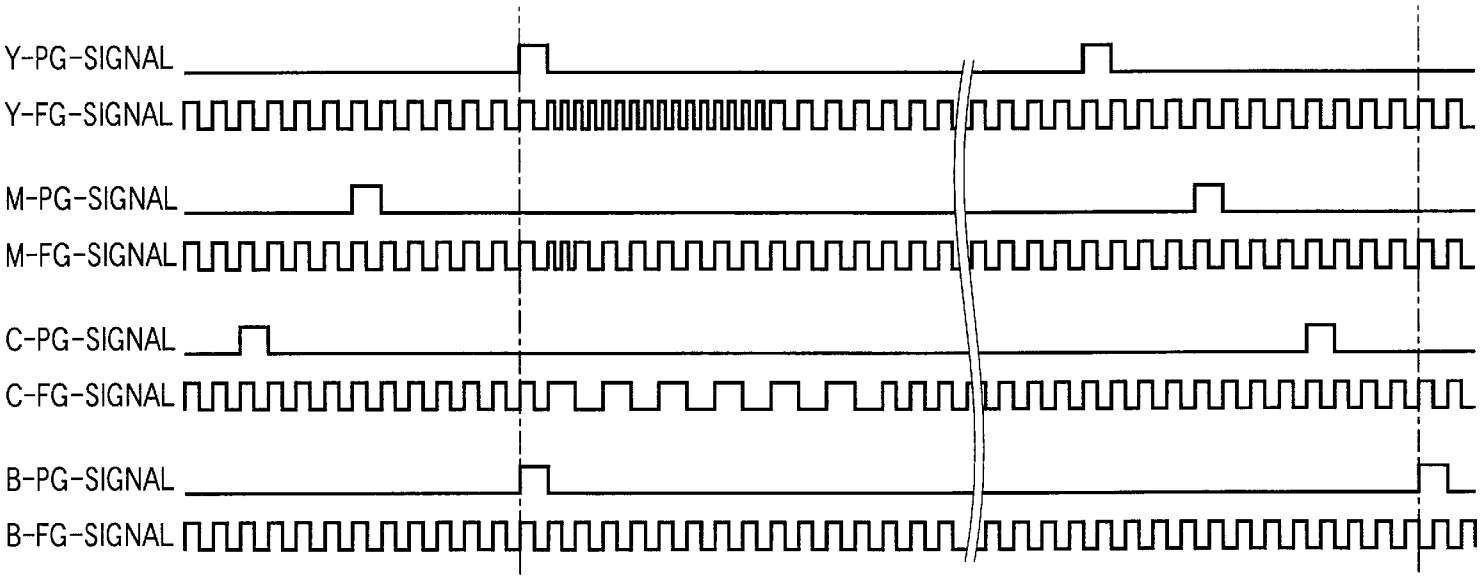
FIGS. 20A to 20H are timing charts for explaining adjustment processing for the relative phases of the photosensitive drums.
Figure 21:
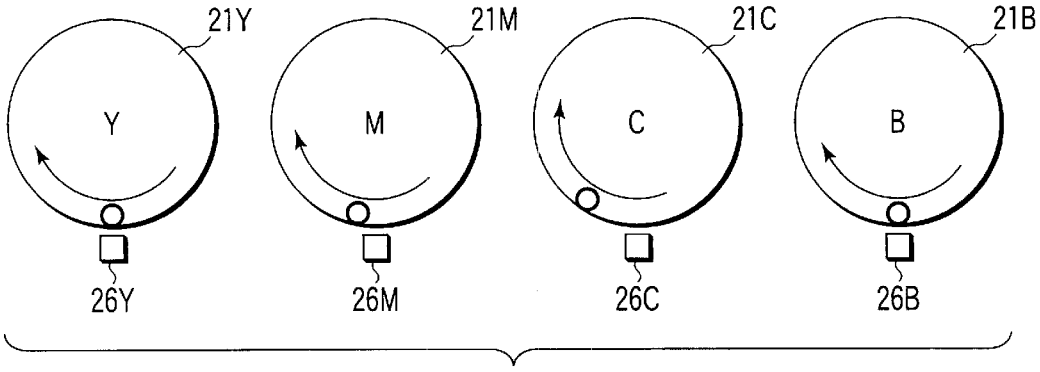
FIG. 21 is a view for explaining the rotational position of each photosensitive drum before relative phase adjustment processing.
Figure 22:
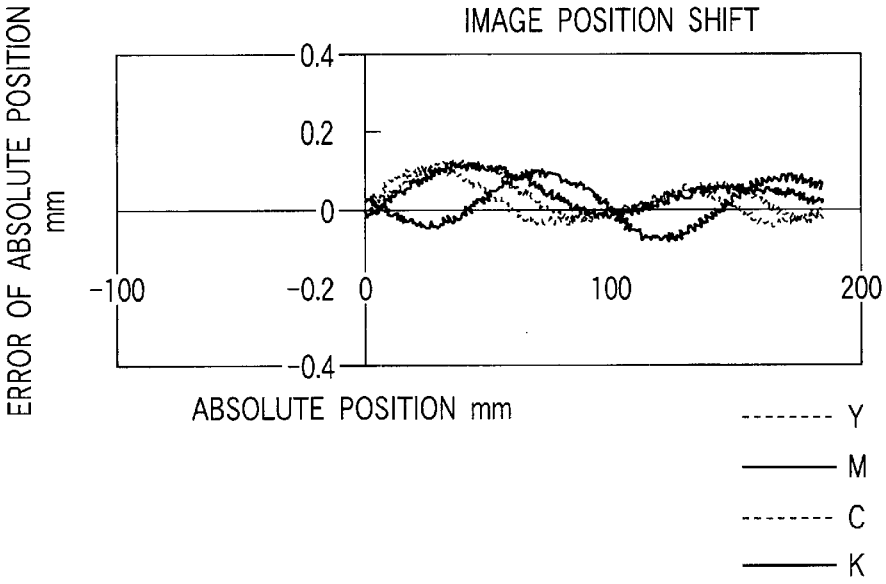
FIG. 22 is a graph showing the image position shift amount in each photosensitive drum before relative phase adjustment processing.

For example, before a B-PG-signal from the PG-signal detection circuit 74B shown in FIG. 20G is output, the rotational timings of the photosensitive drums 21Y, 21M, 21C, and 21B are controlled, as shown in the left side with respect to broken lines in FIGS. 20A, 20C, and 20E and shown in FIG. 21. As shown in FIG. 22, the variation periods of the peripheral speeds of the photosensitive drums 21Y, 21M, 21C, and 21B that appear as sine waves do not match with each other, causing an image position shift.

Figure 23:
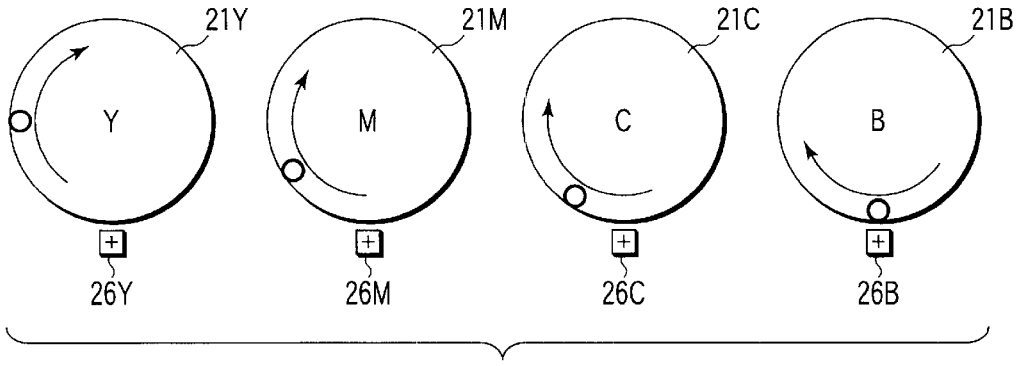
FIG. 23 is a view for explaining the rotational position of each photosensitive drum after relative phase adjustment processing.
Figure 24:
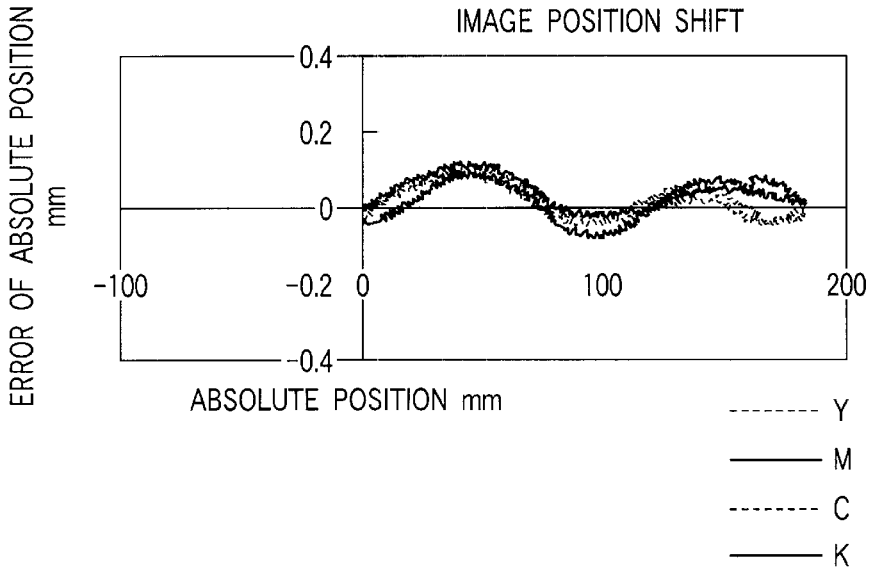
FIG. 24 is a graph showing the image position shift amount in each photosensitive drum after relative phase adjustment processing.

When a B-PG-signal from the PG-signal detection circuit 74B shown in FIG. 20G is output in this state, clocks output from the phase adjustment circuits 39Y, 39M, and 39C are controlled, as described above. The motor control circuits 35Y, 35M, 35C, and 35B control the rotational timings of the photosensitive drums 21Y, 21M, 21C, and 21B, as shown in the right side with respect to the broken lines in FIGS. 20B, 20D, and 20F and shown in FIG. 23. As a result, as shown in FIG. 24, the variation periods of the peripheral speeds of the photosensitive drums 21Y, 21M, 21C, and 21B that appear as sine waves almost match with each other, thus minimizing an image position shift.

Figure 25:
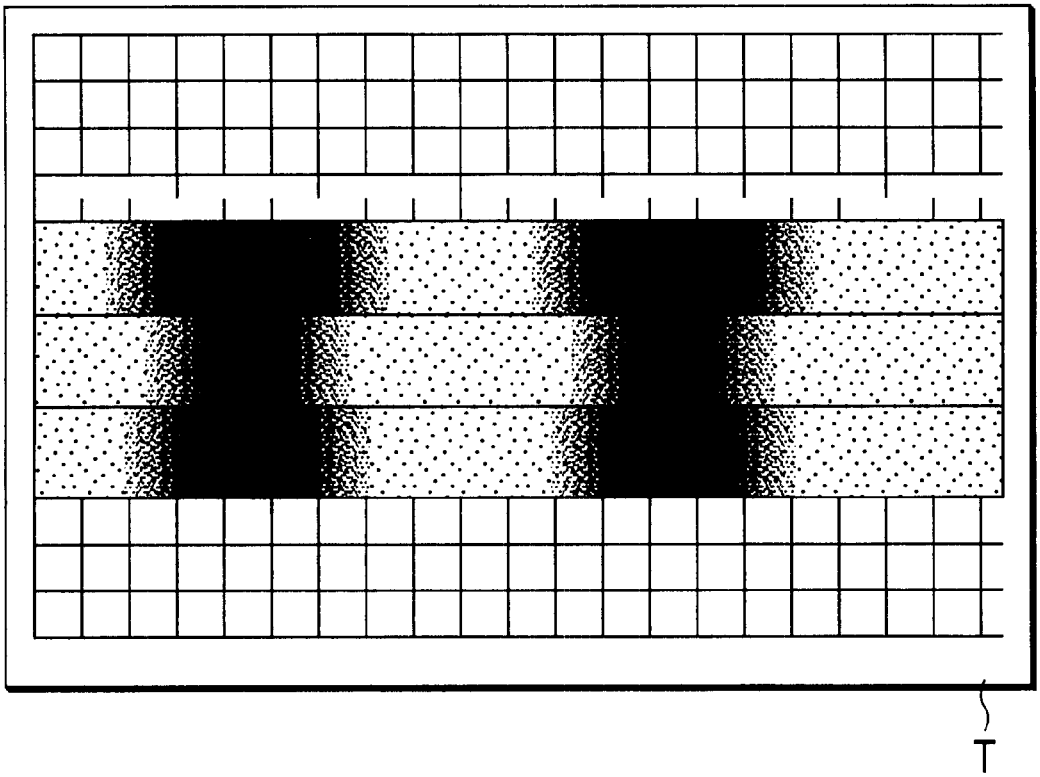
FIG. 25 is a view for explaining the adjustment chart after relative phase adjustment processing.

When, therefore, a relative phase adjustment chart is printed after the adjustment, the density period of the black (B) halftone band Ba, the density period of the cyan (C) halftone band Ca, and the density period of the magenta (M) halftone band Ma almost match with each other as is shown in FIG. 25. The variation periods of the peripheral speeds of the photosensitive drums 21Y, 21M, 21C, and 21B that appear as sine waves can be determined to almost match with each other.

Figure 26:
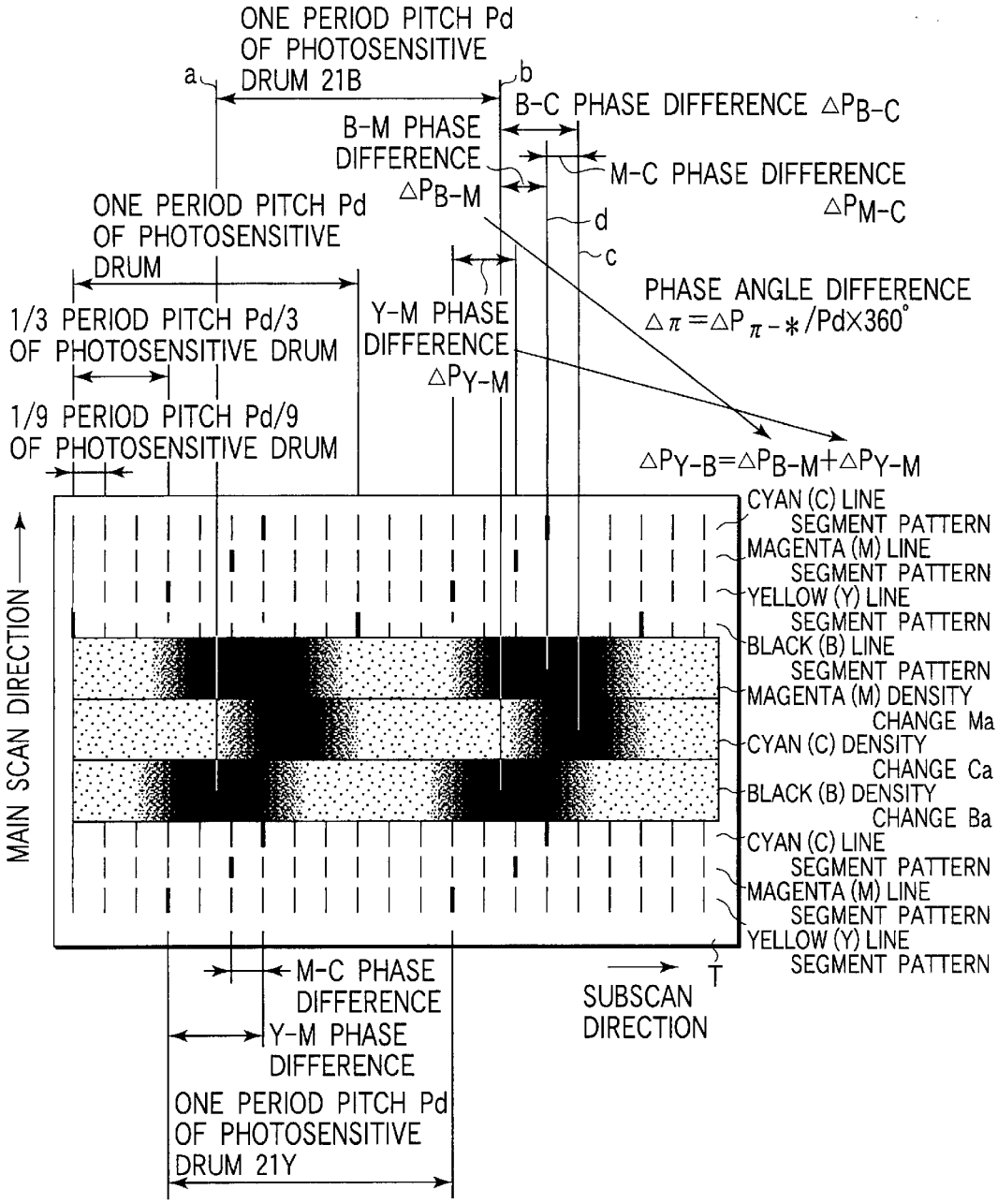
FIG. 26 is a view for explaining the adjustment chart before relative phase adjustment processing.

The relative phase adjustment chart can be a chart shown in FIG. 26 in which lines parallel in the subscan direction that segment each line segment pattern are removed from the chart shown in FIG. 15.

The positions of the DC motors 31Y, 31M, 31C and 31B need not be controlled every time the DC motors are activated. Rather, the positions are controlled only when necessary. For example, they are controlled upon lapse of the time set in a timer provided in the system control section or in accordance with the event management effected by the system control section.

When the positions of the DC motors are controlled, more time may lapse before the copying or printing operation starts. Nonetheless, the event management prevents an increase in the time lapse before the so-called "first print (i.e., outputting of the first printed sheet).

When a copying operation or printing operation event occurs during positioning control, copying operation or printing operation is performed without stopping the DC motors 31Y, 31M, 31C, and 31B.

Second Embodiment

In the second embodiment, the variation period of the peripheral speed of each photosensitive drum is detected using a phase difference detection registration mark transferred to a transfer belt, and the phase is corrected based on the detected variation period of the peripheral speed of the photosensitive drum. The same reference numerals as in the first embodiment denote the same parts, and a description thereof will be omitted.

Figure 27:
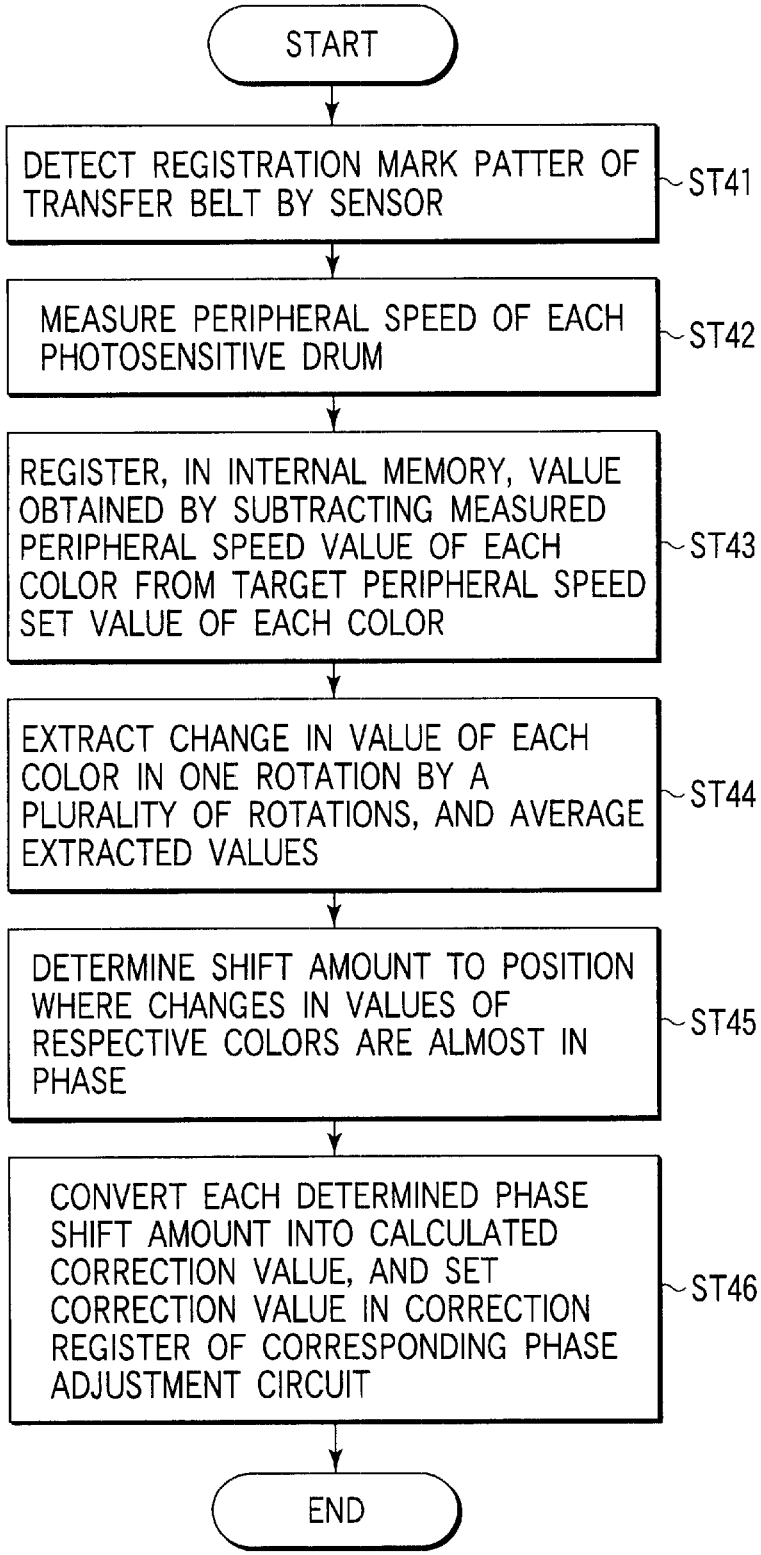
FIG. 27 is a flow chart for explaining processing of adjusting the phase period of peripheral speed variations of photosensitive drums.

Processing of adjusting the phase periods of peripheral speed variations of photosensitive drums 21Y, 21M, 21C, and 21B will be explained with reference to a flow chart shown in FIG. 27.

Upon power-on, a controller 61 reads out a registration mark pattern registered in an internal memory 61*a*. An exposure device 5 is driven on the basis of this mark pattern to form electrostatic latent images corresponding to the pattern on the photo-sensitive drums 21Y, 21M, 21C, and 21B. The electrostatic latent images are developed with corresponding color toners, and transferred to a transfer belt 6 or a sheet P on the transfer belt 6 by transfer devices 26Y, 26M, 26C, and 26B.

Figure 28:
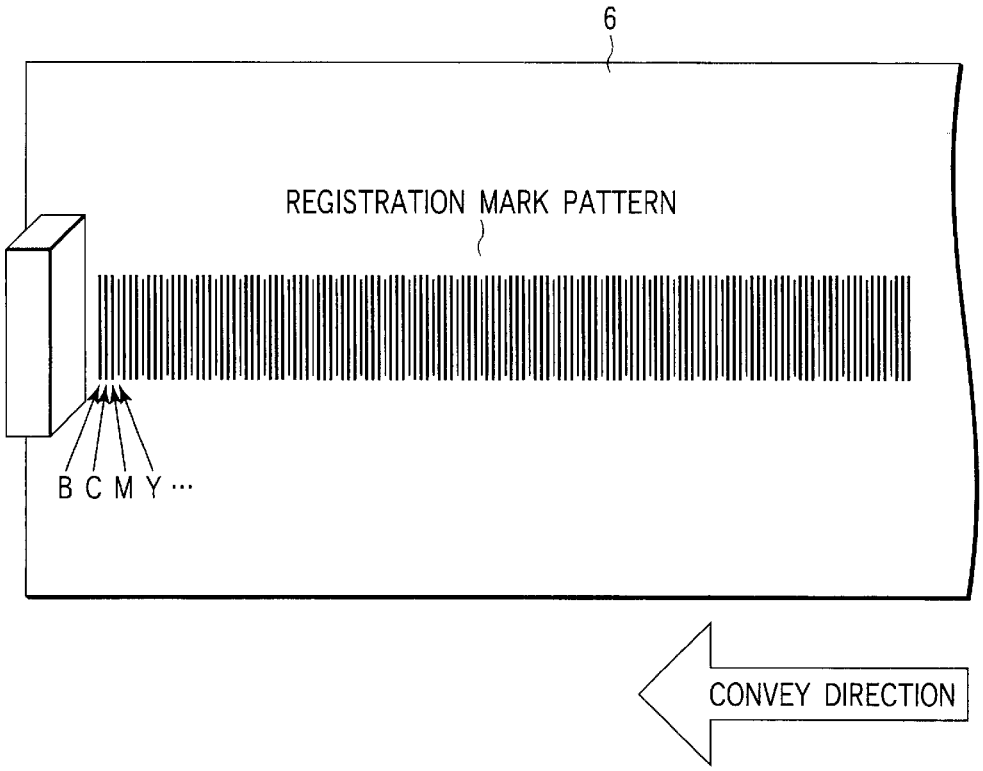
FIG. 28 is a view showing a registration mark pattern.

As shown in FIG. 28, the registration mark pattern includes patterns alternated in units of Y, M, C, and B in a direction perpendicular to the moving direction of the transfer belt 6. The patterns are formed at a predetermined interval in units of colors, and printed apart from each other so as not to overlap patterns of the remaining colors.

In this case, patterns are printed at a pitch obtained by dividing one rotation into 8 to 12.

For example, when the outer diameter of the photosensitive drum is ϕ30 mm, the pitch of one color is about 8 mm, and the pitch between respective colors is about 1 to 2 mm.

$$\phi 30 \times \pi/12 = 7.85 \approx 8 \text{ mm}$$

The registration mark pattern transferred to the transfer belt 6 or the sheet P on the transfer belt 6 is detected by a sensor 27 (ST41).

The controller 61 measures the speeds of the respective colors, i.e., the peripheral speeds of the photosensitive drums 21Y, 21M, 21C, and 21B on the basis of intervals between line segments of the respective colors detected by the sensor 27 (ST42).

Figure 29:
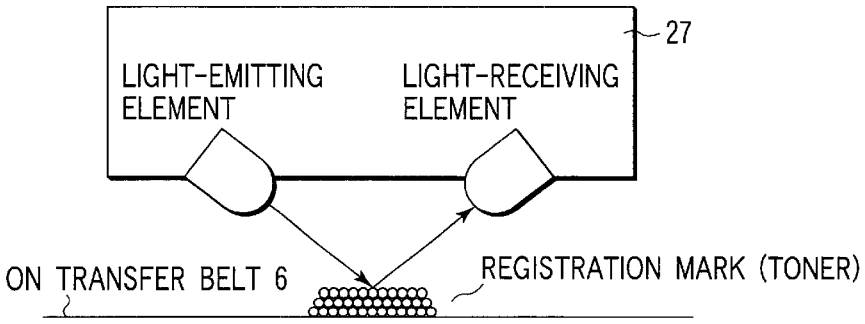
FIG. 29 is a view showing the schematic arrangement of a sensor.

As shown in FIG. 29, the sensor 27 is comprised of a reflection sensor, and successively detects the patterns of the respective colors. The sensor 27 outputs the detection results of the colors to the controller 61.

The controller 61 registers in the internal memory 61*a* a value obtained by subtracting the measured peripheral speed value of each color from the target peripheral speed set value of the color (ST43).

The controller 61 extracts a change in the value of each color for one rotation (change in the peripheral speed of the photosensitive drum) as a result of step 3 by a plurality of number of rotations, and averages the extracted values (ST44).

More specifically, one unit time (=(ϕ30×the length of π)/the speed of the transfer belt) corresponding to one period of the photosensitive drum is set as a storage time width =a time unit, and a time during which the value maximizes or minimizes within the storage time units is extracted for each color. Such values are extracted a plurality of number of times, and averaged.

As a result of step 4, a shift amount to a position where changes in the values of the respective colors are almost in phase is determined (ST45).

The controller 61 converts the determined phase shift amounts into calculated correction values, and sets them in correction registers 54 of corresponding phase adjustment circuits 39Y, 39M, 39C, and 39B (ST46).

The registration mark pattern on the transfer belt 6 is removed after passing by the sensor 27.

Similar to the first embodiment, DC motor positioning control processing is executed at a timing when DC motors 31Y, 31M, 31C, and 31B are activated in power ON operation or copying/printing operation of a color image forming apparatus 1 while the correction values attained by calculating the phase shift amounts are set.

Registration mark patterns may be formed at two portions parallel to each other on the transfer belt 6. In this case, two sensors 27 are set to face each other.

In this case, if processes for the phase shift amounts of the respective colors are parallel-executed to obtain an average value, an error generated by the positional difference along the transfer belt 6 can also be canceled.

In the above example, the rotational DC motors 31Y, 31M, 31C, and 31B of the photosensitive drums 21Y, 21M, 21C, and 21B hardly vary within a very short time in comparison with a stepping motor, and their maximum and minimum rotational speeds appear with a phase of almost 180°.

To increase the precision of the hill and valley (maximum and minimum values), the fact that they appear at 180° is utilized. A difference "(Tmax to Tmin)−T180" between a time "Tmax to Tmin" during which the rotational speed minimizes from a maximum value before averaging and during which the rotational speed minimizes from a maximum value after averaging, and a time T180 corresponding to a phase of 180° is halved. The time value "{(Tmax to Tmin)−T180}/2" is added before and after the time "Tmax to Tmin" so as to uniformly shorten/prolong the time "Tmax to Tmin". 180°-phase matching is performed, and the resultant times are grasped again as the peak times of a hill and valley.

The time differences of the times "Tmax or Tmin" are compared between the respective colors. If 180°-phase matching is not executed, differences between hills and between valleys are independently calculated, "(the difference between hills) +(the difference between valleys)/2" is calculated and compared between the colors. Then, the control enters a sequence of automatically adjusting the phase so as to minimize a shift.

Automatic phase adjustment takes a long time because the gain of relative phase locking control is set low to limit the peripheral speed difference so as not to damage the photosensitive drum. After the end of adjustment, the control returns to the automatic detection sequence again to detect a shift again.

If necessary, the phase is readjusted by a value corresponding to a shift amount obtained from a re-output image.

The correction control takes a ling time in both the first embodiment and the second embodiment. This is inconvenient to the user. The time required to start printing data after the power switch is turned on must be shortened. Thus, the phases of the photosensitive drums, once set, must remain unchanged once even at the time the drums are accelerated or decelerated, until or unless they are forcedly changed to replace any drum with a new one. To this end, two alternative measures may be taken. First, the drums are neither accelerated nor decelerated at a maximum rate. Second, FG pulses are counted for each drum during the acceleration or deceleration of the drums, and phase of each drums is corrected in accordance with the number of FG pulses counted.

What is claimed is:

1. An image forming apparatus characterized by comprising:

a convey portion for conveying a recording medium;

a plurality of image forming units which are aligned on said convey portion, have rotational photosensitive drums, and transfer images of different colors to the recording medium conveyed by said convey portion;

output means for outputting a pattern representing speed changes in one rotation of the photosensitive drums of said respective image forming units;

setting means for setting correction values based on phase differences of the speed changes in one rotation of the photosensitive drums that are determined from an output from said output means; and correction means for locking phases of the speed changes in one rotation of the photosensitive drums by increasing or decreasing rotational speeds of the photosensitive drums on the basis of the correction values set by said setting means.

2. An image forming apparatus according to claim 1, characterized in that said image forming units include units for yellow, magenta, cyan, and black.

3. An image forming apparatus according to claim 1, characterized in that said output means records uniform-density halftone bands for respective colors in a direction parallel to a convey direction of the recording medium.

4. An image forming apparatus according to claim 1, characterized in that said image forming units include units for yellow, magenta, cyan, and black, and said output means prints uniform-density halftone bands alternated in units of magenta, cyan, and black in a direction parallel to a convey direction of the recording medium, and line segment patterns of magenta, cyan, yellow, and black having a predetermined period.

5. An image forming apparatus according to claim 1, characterized in that each halftone band includes an image drawn by 2-pixel modulation at a density of 20 to 30%.

6. An image forming apparatus according to claim 1, characterized in that said image forming units have DC motors for rotating the photosensitive drums.

7. An image forming apparatus according to claim 1, characterized in that said setting means includes:

measurement means for measuring speed changes in one rotation of the respective photosensitive drums, based on the output from said output means;

detecting means for detecting phase differences of the speed changes in one rotation of the photosensitive drums, from the speed changes in one rotation of the respective photosensitive drums, measured by the measurement means and means for setting correction values based on results detected by the detecting means;

and characterized in that:

an encode which outputs encoder pulses of different duty ratios at least once in one rotation of the respective photosensitive drums is provided for each of the photosensitive drums, and one rotation of the respective photosensitive drums is determined based on the encoder pulse when the speed changes are measured by the measurement means.

8. An image forming apparatus according to claim 1, characterized in that phases of the speed changes in each one rotation of the respective sensitive drums are gradually locked when correction is executed by the correction means.

9. An image forming apparatus according to claim 1, characterized in that said setting means includes:

measurement means for measuring speed changes in one rotation of the respective photosensitive drums, based on the output from said output means;

detecting means for detecting phase differences of the speed changes in one rotation of the photosensitive drums, from the speed changes in one rotation of the respective photosensitive drums, measured by the measurement means and means for setting correction values based on results detected by the detecting means;

and characterized in that:

said detection means detects phase differences of the speed changes in one rotation of the respective photosensitive drums from the speed changes in one rotation obtained by averaging those of a plurality of rotations of the respective photosensitive drums, measured by the measurement means.

10. An image forming apparatus comprising:

a convey portion for conveying a recording medium;

a plurality of image forming units which are aligned on said convey portion, have rotational photosensitive drums, and transfer images of different colors to the recording medium conveyed by said convey portion;

output means for outputting a pattern representing speed changes in one rotation of the photosensitive drums of said respective image forming units;

detecting means for detecting phase differences of the speed changes in one rotation of the photosensitive drums, outputted from said plurality of image forming units;

setting means for setting correction values based on results detected by the detecting means; and correction means for locking phases of the speed changes in one rotation of the photosensitive drums by increasing or decreasing rotational speeds of the photosensitive drums on the basis of the correction values set by said setting means.

11. An image forming apparatus according to claim 10, characterized in that said image forming units include units for yellow, magenta, cyan and black.

12. An image forming apparatus according to claim 10, characterized by further comprising:

creating means for creating a pattern of a registration mark for each of different colors;

generating means for generating a toner image of the pattern of the registration mark for each of the different colors, created by the creating means, to the convey portion by said respective image forming units;

a detector, provided along the convey portion on a downstream of the image forming unit, for detecting the toner image of the pattern of the registration mark for the respective colors generated onto the convey portion; and measurement means for measuring speed changes in one rotation of the respective photosensitive drums, based on the pattern of the registration mark for the respective colors, detected by the detector;

and characterized in that:

the phase differences of the speed changes in one rotation of the respective photosensitive drums are detected by the detecting means from the speed changes in one rotation of the respective photosensitive drums, measured by the measurement means.

13. An image forming apparatus according to claim 10, characterized in that said setting means includes:

measurement means for measuring speed changes in one rotation of the respective photosensitive drums, based on the output from said output means;

detecting means for detecting phase differences of the speed changes in one rotation of the photosensitive drums, from the speed changes in one rotation of the respective photosensitive drums, measured by the measurement means; and means for setting correction values based on results detected by the detecting means;

and characterized in that:

an encode which outputs encoder pulses of different duty ratios at least once in one rotation of the respective photosensitive drums is provided for each of the photosensitive drums, and one rotation of the respective photosensitive drums is determined based on the encoder pulse when the speed changes are measured by the measurement means.

14. An image forming apparatus according to claim 10, characterized in that phases of the speed changes in each one rotation of the respective sensitive drums are gradually locked when correction is executed by the correction means.

15. An image forming apparatus according to claim 10, characterized in that said setting means includes:

measurement means for measuring speed changes in one rotation of the respective photosensitive drums, based on the output from said output means;

detecting means for detecting phase differences of the speed changes in one rotation of the photosensitive drums, from the speed changes in one rotation of the respective photosensitive drums, measured by the measurement means; and means for setting correction values based on results detected by the detecting means;

and characterized in that:

said detection means detects phase differences of the speed changes in one rotation of the respective photosensitive drums from the speed changes in one rotation obtained by averaging those of a plurality of rotations of the respective photosensitive drums, measured by the measurement means.

16. An image forming apparatus comprising:

a convey portion for conveying a recording medium;

a plurality of image forming units which are aligned on said convey portion, have rotational photosensitive drums, and transfer images of different colors to the recording medium conveyed by said convey portion;

creating means for creating a pattern of a registration mark for each of said different colors;

generating means for generating a toner image of the pattern of the registration mark for each of the different colors, created by the creating means, to the convey portion by said respective image forming units;

a detector, provided along the convey portion on a downstream of the image forming unit, for detecting the toner image of the pattern of the registration mark for the respective colors generated onto the convey portion;

measurement means for measuring speed changes in one rotation of the respective photosensitive drums, based on the pattern of the registration mark for the respective colors, detected by the detector;

setting means for setting correction values based on results detected by the detecting means; and correction means for locking phases of the speed changes in one rotation of the photosensitive drums by increasing or decreasing rotational speeds of the photosensitive drums on the basis of the correction values set by said setting means.

17. An image forming apparatus according to claim 16, characterized in that the toner image of the pattern of the registration mark for the respective colors generated onto the convey portion is a line segment pattern directed in a main scanning direction within a ¼ period (equivalent to 90 degrees in rotation angle) of one rotation of the photosensitive drum.

18. An image forming apparatus according to claim 16, characterized in that the detector is used further for detecting a color mixing error of the image transferred on a recording medium by the respective image forming units.

19. An image forming apparatus according to claim 16, characterized in that a timing for executing correction by the correction means is compulsively set by setting an adjustment sequence.

20. An image forming apparatus according to claim 16, characterized in that a timing for executing correction by the correction means is automatically set.

21. An image forming apparatus according to claim 16, characterized in that an encode which outputs encoder pulses of different duty ratios at least once in one rotation of the respective photosensitive drums is provided for each of the photosensitive drums, and one rotation of the respective photosensitive drums is determined based on the encoder pulse when the speed changes are measured by the measurement means.

22. An image forming apparatus according to claim 16, characterized in that phases of the speed changes in each one rotation of the respective photosensitive drums are gradually locked when correction is executed by the correction means.

23. An image forming apparatus according to claim 16, characterized in that said image forming units include units for yellow, magenta, cyan and black.

24. An image forming apparatus according to claim 16, characterized by further comprising a driving unit for rotating the respective photosensitive drum, and in that the driving unit is a DC motor.

25. An image forming apparatus according to claim 16, characterized in that a detection means detects phase differences of the speed changes in one rotation of the respective photosensitive drums from a speed change in one rotation, obtained by averaging those of a plurality of rotations of the respective photosensitive drums, measured by the measurement means.

26. An image forming apparatus according to claim 17, characterized in that a detecting means detects a phase difference in the speed change in one rotation of the photosensitive drum in the unit for yellow, a phase difference in the speed change in one rotation of the photosensitive drum in the unit for magenta, and a phase difference in the speed change in one rotation of the photosensitive drum in the unit for cyan, with respect to the speed change in one rotation of the photosensitive drum in the unit for black.

* * * * *